US009956463B2

(12) United States Patent
Franklin et al.

(10) Patent No.: US 9,956,463 B2
(45) Date of Patent: May 1, 2018

(54) GOLF CLUBS AND GOLF CLUB HEADS

(71) Applicant: Nike, Inc., Beaverton, OR (US)

(72) Inventors: David N. Franklin, Granbury, TX (US); Brian Kammerer, Ft. Worth, TX (US)

(73) Assignee: NIKE, Inc., Beaverton, OR (US)

( * ) Notice: Subject to any disclaimer, the term of this patent is extended or adjusted under 35 U.S.C. 154(b) by 445 days.

(21) Appl. No.: 14/290,393

(22) Filed: May 29, 2014

(65) Prior Publication Data

US 2015/0343285 A1 Dec. 3, 2015

Related U.S. Application Data

(63) Continuation-in-part of application No. 13/308,079, filed on Nov. 30, 2011, now Pat. No. 9,072,948.

(51) Int. Cl.
*A63B 53/04* (2015.01)
*A63B 53/06* (2015.01)
(Continued)

(52) U.S. Cl.
CPC ..... *A63B 53/065* (2013.01); *A63B 53/0487* (2013.01); *A63B 60/54* (2015.10); *A63B 69/3638* (2013.01); *A63B 53/04* (2013.01); *A63B 53/06* (2013.01); *A63B 2053/045* (2013.01); *A63B 2053/0408* (2013.01);
(Continued)

(58) Field of Classification Search
USPC ..... 473/324–350
See application file for complete search history.

(56) References Cited

U.S. PATENT DOCUMENTS 537,927 A 4/1895 Rivoire
546,540 A 9/1895 Kennedy
(Continued)

FOREIGN PATENT DOCUMENTS

FR 2672226 A1 8/1992
GB 2374539 A 10/2002
(Continued)

OTHER PUBLICATIONS

Feb. 27, 2013—(WO) ISR & WO—App. No. PCT/US12/067050.
(Continued)

*Primary Examiner* — Alvin Hunter
(74) *Attorney, Agent, or Firm* — Banner & Witcoff, Ltd.

(57) ABSTRACT

Ball striking devices, such as golf clubs, have a head that includes a face member including a face having a striking surface configured for striking a ball and a rear side located behind the face, a rear member connected to the rear side of the face member, a first connection member connecting the face member to the rear member, and a resilient material separating the rear member from the face member. The first connection member is directly engaged with the rear member, and the club head further includes a first spacer separating the first connection member from the face member. The first spacer is flexible, and the first connection member indirectly engages the face member by compressing the first spacer against the face member. The resilient material engages the rear member and the face member and is configured to transfer momentum between the face member and the rear member.

32 Claims, 12 Drawing Sheets

(51) Int. Cl.
*A63B 69/36* (2006.01)
*A63B 60/54* (2015.01)
*A63B 71/06* (2006.01)

(52) U.S. Cl.
CPC ..... *A63B 2053/0416* (2013.01); *A63B 2053/0425* (2013.01); *A63B 2053/0429* (2013.01); *A63B 2053/0433* (2013.01); *A63B 2053/0491* (2013.01); *A63B 2053/0495* (2013.01); *A63B 2071/0694* (2013.01); *A63B 2209/00* (2013.01)

(56) References Cited

U.S. PATENT DOCUMENTS 1,219,417 A 3/1917 Vories
1,222,770 A 4/1917 Kaye
1,429,569 A 9/1922 Craig
1,463,533 A 7/1923 Kurz, Jr.
1,506,733 A 9/1924 Bugbee
1,509,733 A 9/1924 Langford
1,568,485 A 1/1926 Turney
1,594,850 A 8/1926 Perkins
1,867,103 A 7/1932 Schavoir
2,171,383 A 8/1939 Wettlaufer
2,217,338 A 10/1940 Fuller
2,222,534 A 11/1940 Henry
2,305,270 A 12/1942 Nilson
2,329,313 A 9/1943 Winter
2,429,351 A 10/1947 Fetterolf
2,455,150 A 11/1948 Verderber
2,503,506 A 4/1950 Miller
2,520,702 A 8/1950 Verderber
2,571,970 A 10/1951 Verderber
2,593,368 A 4/1952 Verderber
2,777,694 A 1/1957 Winter
3,214,169 A 10/1965 Rupnow
3,305,235 A 2/1967 Williams, Jr.
3,516,674 A 6/1970 Scarborough
3,519,271 A 7/1970 Smith
3,601,399 A 8/1971 Agens et al.
3,791,647 A 2/1974 Verderber
3,840,231 A 10/1974 Moore
3,980,301 A 9/1976 Smith
4,121,832 A 10/1978 Ebbing
D267,965 S 2/1983 Kobayashi
4,632,400 A 12/1986 Boone
4,792,140 A 12/1988 Yamaguchi et al.
4,811,950 A 3/1989 Kobayashi
4,842,280 A 6/1989 Hilton
4,871,174 A 10/1989 Kobayashi
4,878,666 A 11/1989 Hosoda
4,884,808 A 12/1989 Retzer
4,927,144 A 5/1990 Stormon
4,928,972 A 5/1990 Nakanishi et al.
4,984,800 A 1/1991 Hamada
5,154,425 A 10/1992 Niskanen et al.
5,183,255 A 2/1993 Antonious
5,275,413 A 1/1994 Sprague
5,290,036 A 3/1994 Fenton et al.
5,292,123 A 3/1994 Schmidt, Jr. et al.
5,297,803 A 3/1994 Solheim
5,299,807 A 4/1994 Hutin
5,344,151 A 9/1994 Anderson et al.
5,346,213 A 9/1994 Yamada
5,390,920 A 2/1995 Nickum
5,393,056 A 2/1995 Richardson
5,398,929 A 3/1995 Kitaichi
5,407,202 A 4/1995 Igarashi
5,413,337 A 5/1995 Goodman et al.
5,429,356 A 7/1995 Dingle et al.
5,433,441 A 7/1995 Olsen et al.
5,435,551 A 7/1995 Chen
5,439,223 A 8/1995 Kobayashi
5,447,307 A 9/1995 Antonious
5,472,201 A 12/1995 Aizawa et al.
5,485,997 A 1/1996 Schmidt et al.
5,492,327 A 2/1996 Biafore, Jr.
5,516,097 A 5/1996 Huddleston
5,518,240 A 5/1996 Igarashi
5,518,243 A 5/1996 Redman
5,540,436 A 7/1996 Boone
D375,130 S 10/1996 Hlinka et al.
5,564,705 A 10/1996 Kobayashi et al.
5,586,947 A 12/1996 Hutin
5,601,498 A 2/1997 Antonious
5,611,740 A 3/1997 Nagamoto
D378,770 S 4/1997 Hlinka et al.
5,632,695 A 5/1997 Hlinka et al.
5,643,111 A 7/1997 Igarashi
5,649,872 A 7/1997 Antonious
5,658,208 A 8/1997 Shimasaki
5,674,132 A 10/1997 Fisher
5,676,606 A 10/1997 Schaeffer et al.
5,692,972 A 12/1997 Langslet
5,697,855 A 12/1997 Aizawa
5,716,290 A 2/1998 Baker et al.
5,749,794 A 5/1998 Kobayashi et al.
5,755,625 A 5/1998 Jackson
5,772,525 A 6/1998 Klein
5,772,526 A 6/1998 Hano
5,820,481 A 10/1998 Raudman
5,833,551 A 11/1998 Vincent et al.
5,851,157 A 12/1998 Koide et al.
5,863,257 A 1/1999 Busnardo
5,890,976 A 4/1999 Anderson
5,930,887 A 8/1999 Tomita et al.
5,931,741 A 8/1999 Fenton, Jr.
5,993,324 A 11/1999 Gammil
6,001,028 A 12/1999 Tang et al.
6,001,030 A 12/1999 Delaney
6,027,415 A 2/2000 Takeda
6,030,295 A 2/2000 Takeda
6,080,068 A 6/2000 Takeda
6,095,931 A * 8/2000 Hettinger ..... A63B 53/0487 473/341
6,159,109 A 12/2000 Langslet
6,162,133 A 12/2000 Peterson
6,171,204 B1 1/2001 Starry
6,176,791 B1 1/2001 Wright
6,186,903 B1 2/2001 Beebe et al.
6,206,788 B1 3/2001 Krenzler
6,217,461 B1 4/2001 Galy
6,270,423 B1 8/2001 Webb
6,299,546 B1 10/2001 Wang
6,302,807 B1 10/2001 Rohrer
6,328,661 B1 12/2001 Helmstetter et al.
6,332,848 B1 12/2001 Long et al.
6,348,009 B1 2/2002 Dischler
6,386,987 B1 5/2002 Lejeune, Jr.
6,428,423 B1 8/2002 Merko
6,431,997 B1 8/2002 Rohrer
6,440,009 B1 8/2002 Guibaud et al.
6,443,857 B1 9/2002 Chuang
6,478,690 B2 11/2002 Helmstetter et al.
6,491,593 B2 12/2002 Takeda
6,514,153 B2 2/2003 Miyamoto et al.
6,514,155 B1 2/2003 Sheets
6,524,197 B2 2/2003 Boone
6,533,679 B1 3/2003 McCabe et al.
6,558,271 B1 5/2003 Beach et al.
6,625,848 B1 9/2003 Schneider
6,648,773 B1 11/2003 Evans
6,676,533 B1 1/2004 Hsien
6,743,112 B2 6/2004 Nelson
6,769,998 B2 8/2004 Clausen et al.
6,811,496 B2 11/2004 Wahl et al.
6,872,153 B2 3/2005 Gilbert et al.
6,875,124 B2 4/2005 Gilbert et al.
6,899,636 B2 5/2005 Finn
6,932,717 B2 8/2005 Hou et al.
6,964,617 B2 11/2005 Williams
6,991,555 B2 1/2006 Reese
7,025,692 B2 4/2006 Erickson et al.
7,048,646 B2 5/2006 Yamanaka et al.

(56) References Cited

U.S. PATENT DOCUMENTS

| | | | | |
|---|---|---|---|---|
| 7,070,513 | B2 | 7/2006 | Takeda et al. | |
| 7,074,132 | B1 | 7/2006 | Finn | |
| 7,083,525 | B2 | 8/2006 | Pond et al. | |
| 7,108,609 | B2 | 9/2006 | Stites et al. | |
| 7,128,664 | B2 | 10/2006 | Onoda et al. | |
| 7,232,377 | B2 | 6/2007 | Gilbert et al. | |
| 7,244,188 | B2 | 7/2007 | Best | |
| 7,281,985 | B2 | 10/2007 | Galloway | |
| 7,297,072 | B2 | 11/2007 | Meyer et al. | |
| 7,371,190 | B2 | 5/2008 | Gilbert et al. | |
| 7,410,427 | B2 | 8/2008 | Imamoto et al. | |
| 7,410,428 | B1 | 8/2008 | Dawson et al. | |
| 7,419,439 | B1 | 9/2008 | Aleamoni | |
| 7,431,662 | B2 | 10/2008 | Tucker, Sr. et al. | |
| 7,452,283 | B2 | 11/2008 | Hettinger et al. | |
| 7,473,186 | B2 | 1/2009 | Best et al. | |
| 7,530,902 | B2 | 5/2009 | Nakamura | |
| 7,540,810 | B2 | 6/2009 | Hettinger et al. | |
| 7,559,850 | B2 | 7/2009 | Gilbert et al. | |
| 7,566,276 | B2 | 7/2009 | Billings | |
| 7,575,523 | B2 | 8/2009 | Yokota | |
| 7,588,503 | B2 | 9/2009 | Roach et al. | |
| 7,601,077 | B2 | 10/2009 | Serrano et al. | |
| 7,641,569 | B2 | 1/2010 | Best et al. | |
| 7,651,409 | B1 | 1/2010 | Mier | |
| 7,677,987 | B2 | 3/2010 | Hilton | |
| D613,357 | S | 4/2010 | Utz | |
| 7,717,807 | B2 | 5/2010 | Evans et al. | |
| 7,740,545 | B2 | 6/2010 | Cameron | |
| 7,753,809 | B2 | 7/2010 | Cackett et al. | |
| 7,794,334 | B2 * | 9/2010 | Hilton | A63B 53/0487 473/341 |
| 7,798,914 | B2 | 9/2010 | Noble et al. | |
| 7,854,667 | B2 | 12/2010 | Gillig | |
| 7,887,432 | B2 * | 2/2011 | Jones | A63B 53/0487 473/324 |
| 7,892,106 | B2 | 2/2011 | Matsunaga | |
| 7,934,999 | B2 | 5/2011 | Cackett et al. | |
| 7,997,999 | B2 | 8/2011 | Roach et al. | |
| 8,007,371 | B2 | 8/2011 | Breier et al. | |
| 8,057,322 | B2 | 11/2011 | Wallans | |
| 8,092,318 | B2 | 1/2012 | Oldknow et al. | |
| 8,133,128 | B2 | 3/2012 | Boyd et al. | |
| 8,177,664 | B2 | 5/2012 | Horii et al. | |
| 8,206,241 | B2 | 6/2012 | Boyd et al. | |
| 8,210,961 | B2 | 7/2012 | Finn et al. | |
| 8,272,976 | B2 | 9/2012 | DAgostino | |
| 8,333,668 | B2 | 12/2012 | De La Cruz et al. | |
| 8,382,604 | B2 | 2/2013 | Billings | |
| 8,475,292 | B2 | 7/2013 | Rahrig et al. | |
| 8,517,673 | B2 | 8/2013 | Ambrosy et al. | |
| 8,517,851 | B2 | 8/2013 | Cackett et al. | |
| 8,523,698 | B2 * | 9/2013 | Hotaling | A63B 53/04 473/251 |
| 8,535,171 | B2 | 9/2013 | McGinnis, Jr. | |
| 8,608,589 | B2 | 12/2013 | Ferguson et al. | |
| 8,657,702 | B2 | 2/2014 | Boyd et al. | |
| 8,702,533 | B2 | 4/2014 | Evans | |
| 8,771,098 | B2 | 7/2014 | Hilton | |
| 8,900,064 | B2 | 12/2014 | Franklin | |
| 8,956,244 | B1 | 2/2015 | Westrum et al. | |
| 8,979,668 | B2 | 3/2015 | Nakamura | |
| 9,028,342 | B2 | 5/2015 | Stites et al. | |
| 9,033,817 | B2 | 5/2015 | Snyder | |
| 9,072,948 | B2 | 7/2015 | Franklin et al. | |
| 9,089,747 | B2 | 7/2015 | Boyd et al. | |
| 9,101,805 | B2 | 8/2015 | Stites et al. | |
| 9,101,808 | B2 | 8/2015 | Stites et al. | |
| 9,186,546 | B2 | 11/2015 | Boyd et al. | |
| 2002/0025859 | A1 | 2/2002 | Finn | |
| 2002/0169036 | A1 | 11/2002 | Boone | |
| 2003/0032499 | A1 | 2/2003 | Wahl et al. | |
| 2003/0236134 | A1 | 12/2003 | Nishitani | |
| 2004/0018886 | A1 | 1/2004 | Burrows | |
| 2005/0049078 | A1 | 3/2005 | Yamanaka et al. | |
| 2005/0192116 | A1 | 9/2005 | Imamoto | |
| 2005/0272527 | A1 | 12/2005 | Sugimoto | |
| 2006/0148585 | A1 | 7/2006 | Vinton | |
| 2006/0154746 | A1 | 7/2006 | Hagood et al. | |
| 2006/0154747 | A1 | 7/2006 | Beach | |
| 2006/0172816 | A1 | 8/2006 | Johnson | |
| 2007/0129165 | A1 | 6/2007 | Matsunaga et al. | |
| 2007/0142123 | A1 | 6/2007 | Franklin | |
| 2007/0259735 | A1 | 11/2007 | Beckman | |
| 2007/0298904 | A1 | 12/2007 | Dworzan | |
| 2008/0004132 | A1 | 1/2008 | Lin et al. | |
| 2008/0009360 | A1 | 1/2008 | Purtill | |
| 2008/0085781 | A1 | 4/2008 | Iwahori | |
| 2009/0298613 | A1 | 12/2009 | Hirsch et al. | |
| 2010/0029409 | A1 | 2/2010 | Noble et al. | |
| 2010/0167836 | A1 | 7/2010 | Horii et al. | |
| 2010/0184527 | A1 | 7/2010 | Demkowski et al. | |
| 2010/0203983 | A1 | 8/2010 | Stites | |
| 2010/0261546 | A1 | 10/2010 | Nicodem | |
| 2011/0021287 | A1 | 1/2011 | Tucker, Sr. et al. | |
| 2011/0034270 | A1 | 2/2011 | Wahl et al. | |
| 2011/0081987 | A1 | 4/2011 | Gillig | |
| 2011/0086722 | A1 | 4/2011 | Oldknow et al. | |
| 2011/0224017 | A1 | 9/2011 | Thomas et al. | |
| 2011/0275446 | A1 | 11/2011 | Rahrig et al. | |
| 2012/0108357 | A1 | 5/2012 | Nakamura | |
| 2012/0122607 | A1 | 5/2012 | Reinberg | |
| 2013/0095953 | A1 | 4/2013 | Hotaling et al. | |
| 2013/0109501 | A1 | 5/2013 | Stites et al. | |
| 2013/0137533 | A1 | 5/2013 | Franklin et al. | |
| 2013/0157774 | A1 | 6/2013 | Chen | |
| 2013/0178307 | A1 | 7/2013 | Wicketts | |
| 2013/0203522 | A1 | 8/2013 | Franklin et al. | |
| 2013/0281227 | A1 | 10/2013 | Roach et al. | |
| 2014/0045607 | A1 | 2/2014 | Hilton | |
| 2014/0187346 | A1 | 7/2014 | Beno et al. | |
| 2014/0256463 | A1 | 9/2014 | Knight | |
| 2015/0080147 | A1 | 3/2015 | Cameron | |
| 2015/0297959 | A1 | 10/2015 | Lee | |
| 2015/0335966 | A1 | 11/2015 | Cameron | |
| 2016/0129320 | A1 | 5/2016 | Dolezel et al. | |
| 2016/0129321 | A1 | 5/2016 | Dolezel | |

FOREIGN PATENT DOCUMENTS

| | | | |
|---|---|---|---|
| JP | H07031698 | A | 2/1995 |
| JP | H08280854 | A | 10/1996 |
| JP | H09000666 | | 1/1997 |
| JP | H0947531 | A | 2/1997 |
| JP | H09215785 | A | 8/1997 |
| JP | H09215786 | A | 8/1997 |
| JP | H09276455 | A | 10/1997 |
| JP | H10127836 | A | 5/1998 |
| JP | 10201886 | A | 8/1998 |
| JP | 10234890 | A | 9/1998 |
| JP | H1157082 | A | 3/1999 |
| JP | H11114112 | A | 4/1999 |
| JP | H11137731 | A | 5/1999 |
| JP | H11169493 | A | 6/1999 |
| JP | H11178955 | A | 7/1999 |
| JP | H11244431 | A | 9/1999 |
| JP | H11299937 | A | 11/1999 |
| JP | 2000126337 | A | 5/2000 |
| JP | 2000197718 | | 7/2000 |
| JP | 2000288132 | A | 10/2000 |
| JP | 2000350798 | A | 12/2000 |
| JP | 2001054599 | A | 2/2001 |
| JP | 2003265657 | A | 9/2003 |
| JP | 2004141350 | A | 5/2004 |
| JP | 2005131280 | A | 5/2005 |
| JP | 2005211613 | A | 8/2005 |
| JP | 2005245576 | A | 9/2005 |
| JP | 2005305178 | A | 11/2005 |
| JP | 2005342215 | A | 12/2005 |
| JP | 2006000435 | A | 1/2006 |
| JP | 2006280586 | A | 10/2006 |
| JP | 2006296568 | A | 11/2006 |
| JP | 2006333876 | A | 12/2006 |
| JP | 2008006225 | A | 1/2008 |

(56) References Cited

FOREIGN PATENT DOCUMENTS

| | | | |
|---|---|---|---|
| JP | 2008173293 | A | 7/2008 |
| JP | 2009297210 | A | 12/2009 |
| JP | 2010148565 | A | 7/2010 |
| JP | 2010148652 | A | 7/2010 |
| JP | 2010154887 | A | 7/2010 |
| JP | 2010273804 | A | 12/2010 |
| JP | 2011004849 | A | 1/2011 |
| WO | 9709095 | A1 | 3/1997 |
| WO | 9920358 | A1 | 4/1999 |
| WO | 2005007249 | A2 | 1/2005 |
| WO | 2010019636 | A2 | 2/2010 |
| WO | 2013082277 | A1 | 6/2013 |

OTHER PUBLICATIONS

Oct. 28, 2015—(WO) ISR & WO—App. No. PCT/US15/033371.
Sep. 28, 2015—(WO) International Search Report and Written Opinion—App PCT/US2015/032819.
Jul. 12, 2016—(WO) ISR & WO—App. No. PCT/US15/032821.
Oct. 10, 2016—(WO) ISR & WO—App. No. PCT/US16/033014.
Sep. 29, 2016—(WO) International Search Report and Written Opinion—App PCT/US2016/033025.
Oct. 28, 2015—(WO) ISR & WO—App. No. PCT/US15/033128.
Sep. 11, 2015—(WO) ISR & WO—App. No. PCT/US15/032665.

* cited by examiner

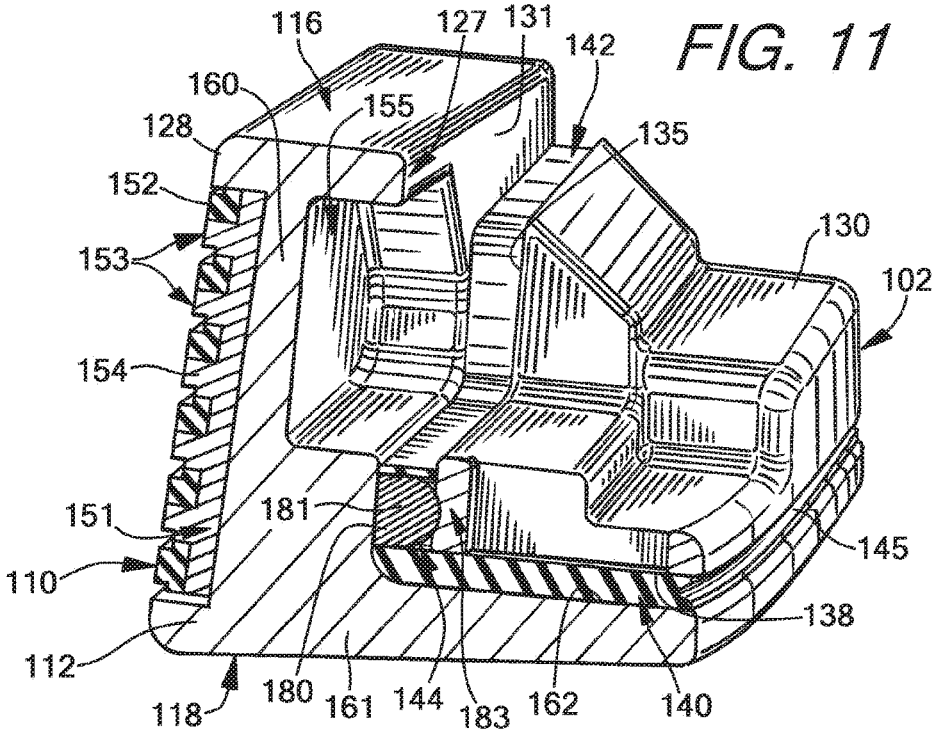
FIG. 11
FIG. 12
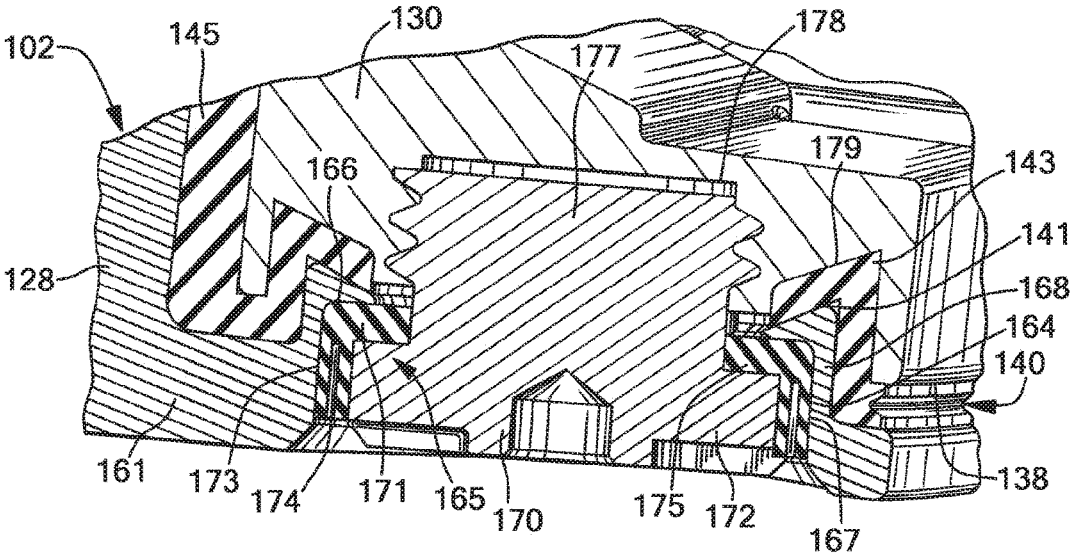

GOLF CLUBS AND GOLF CLUB HEADS

CROSS REFERENCE TO RELATED APPLICATION

This application claims priority to, and is a continuation-in-part of, co-pending U.S. patent application Ser. No. 13/308,079, filed Nov. 30, 2011.

TECHNICAL FIELD

The invention relates generally to ball striking devices, such as golf clubs and golf club heads, utilizing features for transfer of energy and/or momentum. Certain aspects of this invention relate to golf club heads having a rear member configured to transfer energy and/or momentum to the face upon an impact on the face.

BACKGROUND

Golf clubs and many other ball striking devices can encounter undesirable effects when the ball being struck impacts the ball striking head away from the optimum location, which may be referred to as an "off-center impact." In a golf club head, this optimum location is, in many cases, aligned laterally and/or vertically with the center of gravity (CG) of the head. Even slightly off-center impacts can sometimes significantly affect the performance of the head, and can result in reduced velocity and/or energy transfer to the ball, inconsistent ball flight direction and/or spin caused by twisting of the head, increased vibration that can produce undesirable sound and/or feel, and other undesirable effects. Technologies that can reduce or eliminate some or all of these undesirable effects could have great usefulness in golf club heads and other ball striking devices.

The present devices and methods are provided to address at least some of the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the disclosure relate to ball striking devices, such as golf clubs, with a head that includes a face member including a face having a striking surface configured for striking a ball and a rear side located behind the face, a rear member connected to the rear side of the face member, a first connection member connecting the face member to the rear member, and a resilient material separating the rear member from the face member. The first connection member is directly engaged with the rear member, and the club head further includes a first spacer separating the first connection member from the face member. The first spacer is flexible, and the first connection member indirectly engages the face member by compressing the first spacer against the face member. The resilient material engages the rear member and the face member and is configured to transfer momentum between the face member and the rear member. The golf club head may further include any other aspects of the disclosure described herein.

According to one aspect, the club head may further include an engagement member rigidly engaging the face member and the rear member to form a joint, where the engagement member forms a sole point of rigid engagement between the face member and the rear member. The engagement member may be in the form of a projection fixed to one of the face member and the rear member and abutting the other of the face member and the rear member. The resilient material may have a gap allowing the engagement member to extend through the resilient material to engage both the face member and the rear member.

According to another aspect, the club head may include a second connection member connecting the face member to the rear member, where the second connection member is directly engaged with the rear member. The club head may further include a second flexible spacer separating the second connection member from the face member, where the second connection member indirectly engages the face member by compressing the second spacer against the face member. In one configuration, the first connection member is positioned in a heel portion of the club head and the second connection member is positioned in a toe portion of the club head.

According to another aspect, the connection member or members may each have a threaded portion and an enlarged head, and the rear member has one or more threaded receivers receiving and engaging the threaded portion of the connection member. The face member may further have one or more openings, with a shoulder surrounding each opening, such that each connection member extends through the opening and into the receiver. The spacers are each positioned around the opening and engaged between the enlarged head and the shoulder. The face member may further have a cavity surrounding each opening, with the cavity being wider than the opening and defined by a cylindrical projection extending from the face member toward the rear member. In this configuration, the shoulder may be defined within the cavity, and the enlarged head of the first connection member and the first spacer are received in the cavity. Further, the rear member may have a channel surrounding each receiver, where a portion of each cylindrical projection is received within the corresponding channel. Still further, the resilient material may have portions that are received within the channels to separate each cylindrical projection from the rear member. In this configuration, each cavity may have a cylindrical side wall that is transverse to the respective shoulder, where each spacer is further positioned between the enlarged head of the respective connection member and the corresponding side wall.

According to a further aspect, the face member includes a face portion defining at least a portion of the face and a sole portion extending rearward from the face portion and forming at least a portion of a sole of the club head. The rear member is positioned behind the face portion and above the sole portion, and the first connection member connects the sole portion to an underside of the rear member. The first connection member may have a threaded portion and an enlarged head, and the rear member may have a threaded receiver on the underside that receives and engages the threaded portion of the first connection member. In this configuration, the face member may further have an opening in the sole portion and a shoulder surrounding the opening, such that the first connection member extends upwardly through the opening and into the receiver, and the first spacer is positioned around the opening and is engaged between the enlarged head and the shoulder.

Additional aspects of the disclosure relate to ball striking devices, such as golf clubs, with a head that includes a face member including a face having a striking surface configured for striking a ball and a rear side located behind the face, a rear member connected to the rear side of the face member, a resilient material separating the rear member from the face member, and first and second connection members connecting the face member to the rear member. The face member includes a face portion at least partially defining the face and a sole portion extending rearward from the face portion and forming at least a portion of a sole of the club head, with the sole portion having a first opening on a heel side of the club head and a second opening on a toe side of the club head. The rear member has first and second receivers located on its underside, with the first receiver aligned with the first opening and the second receiver aligned with the second opening. The resilient material engages the rear member and the face member and is configured to transfer momentum between the face member and the rear member. Each connection member extends upward through one of the openings in the face member and into the corresponding receiver, and the connection members engage the corresponding receivers by complementary threading members. The sole portion and the face portion of the face member are formed of a single integral piece, in one configuration. The golf club head may further include any other aspects of the disclosure described herein.

According to one aspect, the first and second connection members are separated from one of the face member and the rear member by a flexible material to prevent rigid engagement with the first and second connection members. The club head may further include an engagement member rigidly engaging the face member and the rear member to form a joint, where the engagement member forms a sole point or area of rigid engagement between the face member and the rear member.

According to another aspect, the sole portion of the face member and the rear member each have a first leg extending rearwardly along the heel side of the club head and a second leg extending rearwardly along the toe side of the club head, where the first and second legs of the face member and the rear member are spaced from each other to define a void at a rear central portion of the club head. The first receiver may be defined within the first leg of the rear member and the second receiver may be defined within the second leg of the rear member, and the first opening may be defined within the first leg of the face member and the second opening may be defined within the second leg of the face member. In one configuration, the void is narrower proximate the face and wider proximate a rear of the club head.

Further aspects of the disclosure relate to ball striking devices, such as golf clubs, with a head that includes a face member including a face having a striking surface configured for striking a ball and a rear side located behind the face, a rear member connected to the rear side of the face member, a first connection member connecting the face member to the rear member, and a resilient material separating the rear member from the face member. The face member has a first opening therein and the rear member has a second opening therein, the second opening being aligned with the first opening. The first connection member is received in the first opening and the second opening to connect the face member to the rear member. The first connection member may directly and rigidly engage only one of the face member and the rear member. In other words, the first connection member indirectly engages one of the face member and the rear member due to a first flexible spacer positioned around at least a portion of the first connection member and separating the first connection member from the one of the face member and the rear member, and the first connection member directly and rigidly engages the other of the face member and the rear member. The resilient material engages the rear member and the face member and is configured to transfer momentum between the face member and the rear member. The golf club head may further include any other aspects of the disclosure described herein.

According to one aspect, the face member has a third opening and the rear member has a fourth opening aligned with the third opening, and the club head further includes a second connection member connecting the face member to the rear member. The second connection member may directly and rigidly engage only one of the face member and the rear member, in the same manner described above with respect to the first connection member, and a second flexible spacer may be included for this purpose. The rear member may have perimeter weighting members on a heel side and a toe side of the club head and a thinned center portion, and the second opening and the fourth opening may be located in the perimeter weighting members. Additionally, the face member may include a face portion at least partially defining the face and a sole portion extending rearward from the face portion and forming at least a portion of a sole of the club head, where the first and third openings are formed in the sole portion of the face member, and where the second and fourth openings are formed in an underside of the rear member.

Still further aspects of the disclosure relate to ball striking devices, such as golf clubs, with a head that includes a face member including a face having a striking surface configured for striking a ball and a rear side located behind the face, a rear member connected to the rear side of the face member, a resilient material separating the rear member from the face member, first and second connection members connecting the face member to the rear member, and an engagement member rigidly engaging the face member and the rear member to form a joint. The face member has a first opening on a heel side of the club head and a second opening on a toe side of the club head, and the rear member has first and second receivers aligned with the first and second openings. Each connection member extends through the respective opening in the face member and into the corresponding receiver, such that each connection member directly and rigidly engages the respective receiver. The club head further includes flexible spacers separating the connection members from the face member, and the connection members indirectly engage the face member by compressing the spacers against the face member. In this configuration, the resilient material engages the rear member and the face member and is configured to transfer momentum between the face member and the rear member, and the engagement member forms a sole area of rigid engagement between the face member and the rear member. The golf club head may further include any other aspects of the disclosure described herein.

According to one aspect, the engagement member is a projection immovably fixed to one of the face member and the rear member and abutting the other of the face member and the rear member. Additionally, the engagement member may be laterally aligned with the center of gravity of the face member and the center of gravity of the rear member.

Other aspects of the invention relate to a golf club or other ball striking device including a head or other ball striking device as described above and a shaft connected to the head/device and configured for gripping by a user. The shaft may be connected to the face member of the head. Aspects of the invention relate to a set of golf clubs including at least one golf club as described above. Yet additional aspects of the invention relate to a method for manufacturing a ball striking device as described above, including connecting a rear member and/or a resilient material to a face member as described above.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which:

FIG. 11 is a cross-section view taken along line 11-11 in FIG. 2;

FIG. 12 is a cross-section view taken along line 12-12 in FIG. 2;

DETAILED DESCRIPTION

Figure 1:
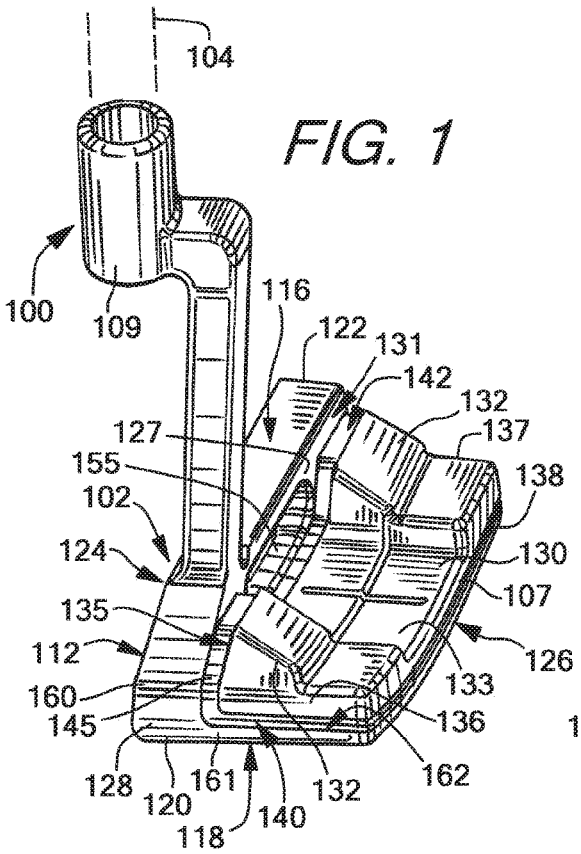
FIG. 1 is a top rear perspective view of one embodiment of a ball striking device according to aspects of the present invention, in the form of a golf putter.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," "primary," "secondary," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The term "shaft" includes the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like. In many bonds made by "integral joining techniques," separation of the joined pieces cannot be accomplished without structural damage thereto.

"Approximately" or "about" means within a range of +/−10% of the nominal value modified by such term.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface may constitute a substantially flat surface on one face of the ball striking head, although some curvature may be provided (e.g., "bulge" or "roll" characteristics). Some more specific aspects described herein relate to putters and putter heads, although aspects described herein may also be utilized in wood-type golf clubs and golf club heads, including drivers, fairway woods, hybrid-type clubs, as well as iron-type golf clubs, other types of golf clubs or other ball striking devices, if desired.

According to various aspects of this invention, the ball striking device may be formed of one or more of a variety of materials, such as metals (including metal alloys), ceramics, polymers, composites, fiber-reinforced composites, and wood, and the devices may be formed in one of a variety of configurations, without departing from the scope of the invention. In one embodiment, some or all components of the head, including the face and at least a portion of the body of the head, are made of metal materials. It is understood that the head also may contain components made of several different materials. Additionally, the components may be formed by various forming methods. For example, metal components (such as titanium, aluminum, titanium alloys, aluminum alloys, steels (such as stainless steels), and the like) may be formed by forging, molding, casting, stamping, machining, and/or other known techniques. In another example, polymer or composite components, such as carbon fiber-polymer composites, can be manufactured by a variety of composite processing techniques, such as prepreg processing, powder-based techniques, injection molding, mold infiltration, and/or other known techniques.

The various figures in this application illustrate examples of ball striking devices and portions thereof according to this invention. When the same reference number appears in more than one drawing, that reference number is used consistently in this specification and the drawings to refer to the same or similar parts throughout.

At least some examples of ball striking devices according to this invention relate to golf club head structures, including heads for putter-type golf clubs. Such devices may include a one-piece construction or a multiple-piece construction. An example structure of ball striking devices according to this invention will be described in detail below in conjunction with FIGS. 1-14, and will be referred to generally using reference numeral "100."

FIGS. 1-14 illustrate an example of a ball striking device 100 in the form of a golf putter, in accordance with at least some examples of this invention. The ball striking device 100 includes a ball striking head 102 and a shaft 104 connected to the ball striking head 102 and extending therefrom. The ball striking head 102 of the ball striking device 100 of FIGS. 1-4 has a face member 128 that includes a face 112 and a hosel 109 extending therefrom. The face member 128 may include one or more structures connected to and/or located behind the face 112 that may be referred to as part of a "body" of the golf club head 102. The ball striking head 102 also has a rear member 130 connected to the face member 128, and a resilient material 140 positioned between the face member 128 and the rear member 130. The face member 128, the rear member 130, and the resilient material 140 may combine to define the golf club head body 107 in some embodiments. The shaft 104 may be connected to the body 107 at the hosel 109, as shown in FIG. 1, and may include a grip (not shown) in some embodiments. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Patent Application Publication No. 2009/0062029, filed on Aug. 28, 2007, U.S. Patent Application Publication No. 2013/0184098, filed on Oct. 31, 2012, and U.S. Pat. No. 8,533,060, issued Sep. 10, 2013, all of which are incorporated herein by reference in their entireties and made parts hereof.

For reference, the head 102 generally has a golf club head body 107 with a top 116, a bottom or sole 118, a heel 120 (also called a heel side or heel edge) proximate the hosel 109, a toe 122 (also called a toe side or toe edge) distal from the hosel 109, a front side 124, and a back or rear side 126. The shape and design of the head 102 may be partially dictated by the intended use of the device 100. In the club 100 shown in FIGS. 1-14, the head 102 has a wide, narrow or short face 112, as the club 100 is designed for use as a putter, intended to hit the ball short distances in a rolling manner. It is understood that the head 102 may be configured as a different type of ball striking device in other embodiments, including other types of putters or similar devices. In other applications, such as for a different type of golf club, the head may be designed to have different dimensions and configurations. If, for example, the head 102 is configured as a driver, the club head may have a volume of at least 400 cc, and in some structures, at least 450 cc, or even at least 460 cc. When configured as a fairway wood head, the club head may have a volume of at least 120-230 cc, and when configured as a hybrid club head, the club head may have a volume of at least 85-140 cc. Other appropriate sizes for other club heads may be readily determined by those skilled in the art.

The face 112 is located at the front 124 of the face member 128, and has a striking surface or ball striking surface 110 located thereon. The ball striking surface 110 is configured to face a ball in use (not shown), and is adapted to strike the ball when the device 100 is set in motion, such as by swinging. As shown, the ball striking surface 110 occupies most of the face 112. The face 112 may include some curvature in the top to bottom and/or heel to toe directions (e.g., bulge and roll characteristics), and may also include functional face grooves, as is known and is conventional in the art. In other embodiments, the surface 110 may occupy a different proportion of the face 112, or the face member 128 may have multiple ball striking surfaces 110 thereon. In the embodiment shown in FIGS. 1-14, the ball striking surface 110 has little to no incline or loft angle, to cause the ball to roll when struck. In other embodiments, the ball striking surface 110 may have an incline or loft angle, to launch the ball on a trajectory, such as for a wood-type or iron-type club head. Additionally, the face 112 may have one or more internal or external inserts in some embodiments.

It is understood that the face member 128 and/or the hosel 109 can be formed as a single piece or as separate pieces that are joined together. In the embodiment shown in FIGS. 1-14, as well as the embodiments shown in FIGS. 15-22, the face member 128, including the face 112 and potentially the hosel 109, are formed of a single, integral piece. In other embodiments, the face member 128 may be formed of multiple pieces, such as by using an insert to form all or part of the face 112, or a separate body member or members connected behind the face 112. Such multiple pieces may be joined using an integral joining technique, such as welding, cementing, or adhesively joining, or other known techniques, including many mechanical joining techniques, such as releasable mechanical engagement techniques. Further, the hosel 109 may also be formed as a separate piece, which may be joined using these or other techniques, or may be connected to the rear member 130. In an exemplary embodiment, the face 112 may include a face insert 150 that forms at least a portion of the ball striking surface 110, including inserts as described in U.S. Patent Application Publication 2010/0234127, which is incorporated by reference herein in its entirety and made part hereof.

Figure 6A:
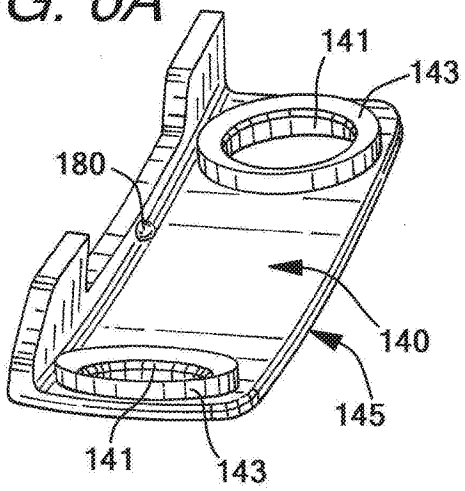
FIG. 6A is a top rear perspective view of another embodiment of a resilient member for use with a ball striking device according to aspects of the present invention, in the form of a golf putter.
Figure 4:
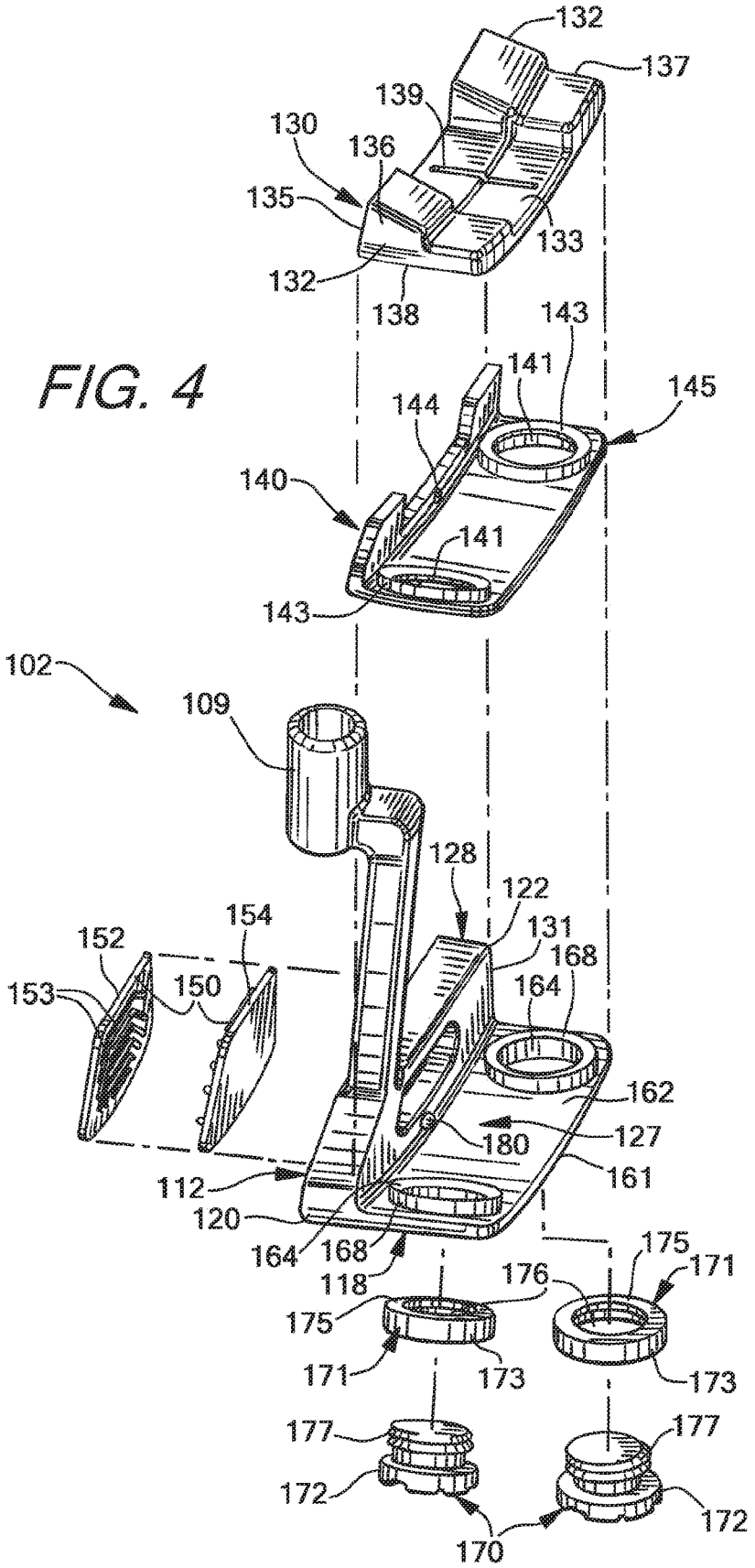
FIG. 4 is a top rear perspective exploded view of the ball striking device of FIG. 1.
Figure 6:
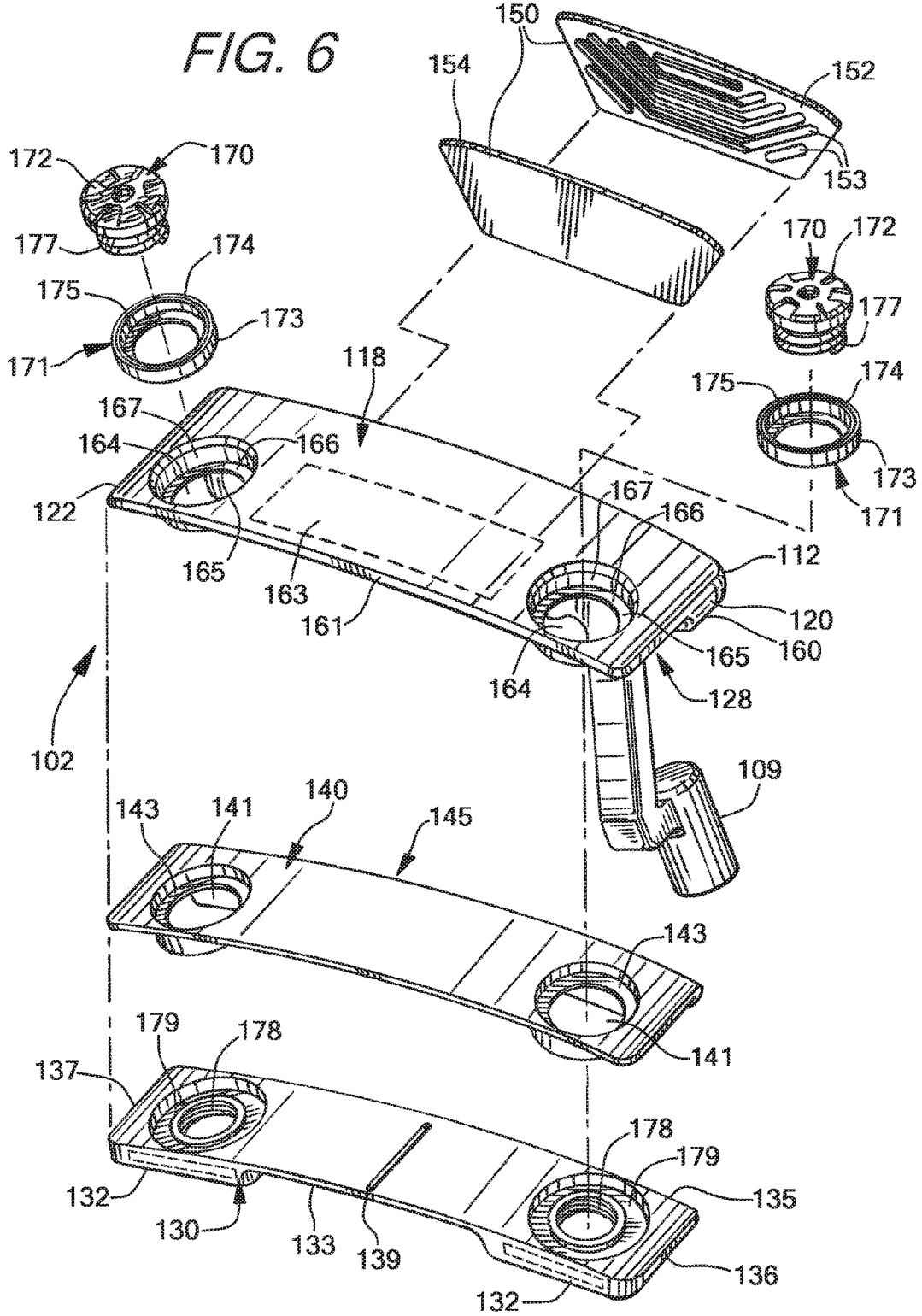
FIG. 6 is a bottom rear perspective exploded view of the ball striking device of FIG. 1.
Figure 7:
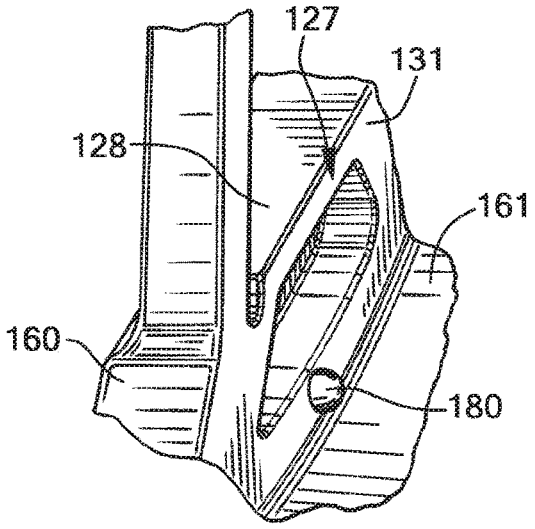
FIG. 7 is a magnified view of a portion of a face member of the ball striking device of FIG. 1.

FIGS. 4, 6, and 11 illustrate one embodiment of a face insert 150 for the golf club head 102. In this embodiment, at least a portion of the ball striking surface 110 may be formed separately from the remainder of the face 112 and may include an insert 150 configured to be received in a recess 151 formed in the face 112. In the embodiment illustrated in FIGS. 4, 6, and 11, the insert 150 includes a plate 152, into which grooves 153 of various sizes, configurations, shapes, etc., may be machined or otherwise formed. In some examples, the plate 152 may be between 1 mm and 4 mm thick and, in some examples, may be approximately 2 or 3 mm thick. The grooves 153 may, in some arrangements, extend completely through the plate 152 (i.e., forming a through hole in the plate), as shown in FIGS. 4, 6, and 11, or may extend partially through the plate 152. The plate 152 may be formed of any suitable material, including metals such as aluminum, steel (e.g., stainless steel), titanium, nickel, beryllium, copper, combinations or alloys including these metals; polymers; and the like. The plate 152 may be pressed together (e.g., by "co-molding") with a moldable, polymer material backing 154, such as thermoplastic polyurethane or a thermoset material. The polymer material 154 may have a lower hardness than the plate 152 in one embodiment, e.g., as determined by a Shore D hardness test. In another embodiment, the polymer material 154 may have greater hardness. Connecting the polymer material 154 together with the front plate 152 forms the insert 150 having the polymer material 154 filling the grooves 153 formed in the plate 152, to provide a ball striking surface having two different materials that may have different hardnesses (e.g., metal and polymer) contacting the ball. The surface of the polymer backing material 154 may be pre-formed with projections to fit into the grooves 153, and/or the polymer material 154 may be forced into the grooves 153 during a pressing and/or molding operation. If necessary or desired, the plate 152 and polymer material 154 may be held together using an adhesive or cement (e.g., double sided tape), mechanical connectors, fusing techniques (e.g., welding, soldering, or brazing), etc. Further, if desired, score lines may be cut into the polymer material 154 and/or the plate 152 after the insert 150 has been manufactured. The insert 150 may be engaged with the recess 151 in the face 112 in any desired manner, such as via any joining techniques described herein, and may be releasably connected in one embodiment.

Figure 2:
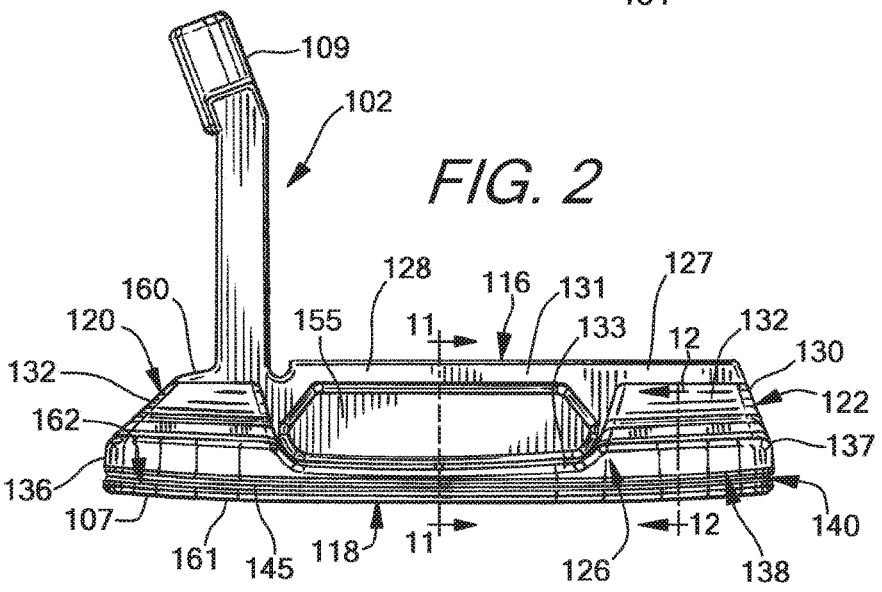
FIG. 2 is a rear view of the ball striking device of FIG. 1.
Figure 5:
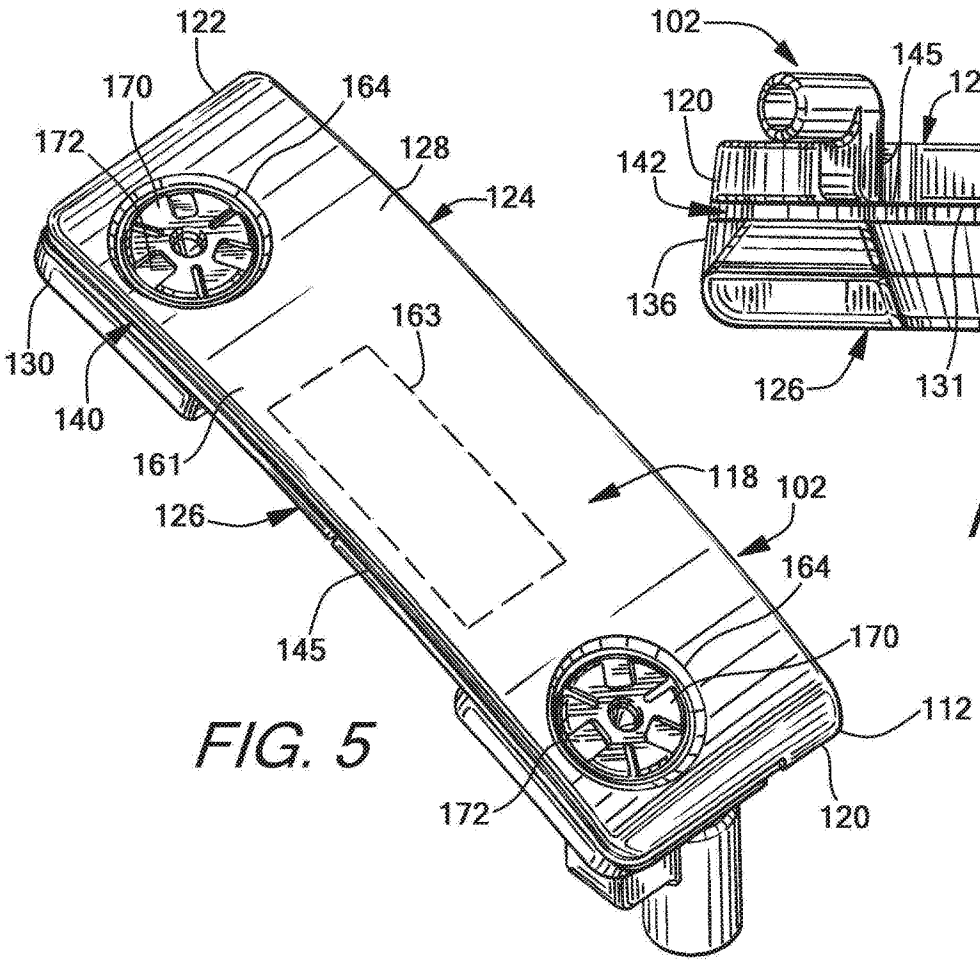
FIG. 5 is a bottom rear perspective view of the ball striking device of FIG. 1.

The face member 128 in the embodiment of FIGS. 1-14 has a face portion 160 that defines at least a portion of the face 112 and a rearwardly-extending portion or sole portion 161 that extends rearwardly from the face portion 160. The face portion 160 generally defines at least a portion of the striking surface 110, which may also be partially defined by the face insert 150 in an embodiment as described above. In the embodiment shown in FIGS. 1-14, the rear side 127 of the face member 128 has a rear surface 131 opposite the striking surface 110. The rear surface 131 may be partially or entirely defined on the face portion 161 of the face member 128 in one embodiment, and may be considered to be a rear surface of the face 112 in the configuration illustrated in FIGS. 1-14. The face portion 160 may also have a rear cavity 155 in the rear surface 131 in one embodiment, such as illustrated in FIGS. 1-2 and 11, which may be located at least partially behind the face insert 150. In the embodiment of FIGS. 1-14, the rear cavity 155 extends only partially through the face portion 160, however in another embodiment, the rear cavity 155 may extend completely through the face portion 160 to be contiguous with the recess 151 receiving the face insert 150. No rear cavity 155 may be present in a further embodiment. The sole portion 161 defines at least a portion of the sole 118 of the club head 102 in one embodiment, and the sole portion 161 defines substantially the entire sole 118 of the club head 102 in the embodiment as illustrated in FIG. 5. In another embodiment, the rear member 130 may form at least a portion of the sole 118. Additionally, in the embodiment of FIGS. 1-14, the sole portion 161 has approximately the same width (heel-to-toe) as the face portion 160. As shown in FIG. 4, the top surface 162 of the sole portion 161 is smooth, however the top surface 162 may have a different structure in another embodiment, such as in the embodiment of FIGS. 15-19. In one embodiment, the sole portion 161 may include indicia formed by one or more openings 163 through the sole portion 161, as schematically illustrated in FIG. 5. Although not illustrated in FIG. 5, the indicia formed by the opening(s) 163 may include logos, brand names, performance information, among other information. The opening(s) 163 may expose a portion of the resilient material 140, and the resilient material 140 may be a highly visible color in one embodiment, which highlights this indicia. Further, a portion of the resilient material 140 may protrude into the opening(s) 163, and may be substantially flush with the adjacent portions of the sole 118.

The ball striking device 100 may include a shaft 104 connected to or otherwise engaged with the ball striking head 102, as shown in FIG. 1. The shaft 104 is adapted to be gripped by a user to swing the ball striking device 100 to strike the ball. The shaft 104 can be formed as a separate piece connected to the head 102, such as by connecting to the hosel 109, as described above. In other embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some exemplary embodiments, the shaft 104, or at least portions thereof, may be constructed of a metal, such as stainless steel, or a composite, such as a carbon/graphite fiber-polymer composite. However, it is contemplated that the shaft 104 may be constructed of different materials without departing from the scope of the invention, including conventional materials that are known and used in the art.

In general, the head 102 of the ball striking device 100 has a rear member 130 (which may also be referred to as a "weight member") connected to the face member 128 at the rear side 127 of the face member 128, and the rear member 130 has a front surface 135 that faces and confronts the rear surface 131 of the face member 128. In general, the rear member 130 is configured to transfer energy and/or momentum to the face member 128 upon impact of the ball on the striking surface 110, including an off-center impact. The underside 138 of the rear member 130 may also confront the top surface 162 of the sole portion 161 of the face member 128, such as in the embodiment of FIGS. 1-14. In one embodiment, the face member 128 and the rear member 130 follow generally the same outer periphery, as illustrated in FIGS. 1, 2, and 11, however in other embodiments, at least a portion of these members 128, 130 may have a different outer periphery.

Figure 1A:
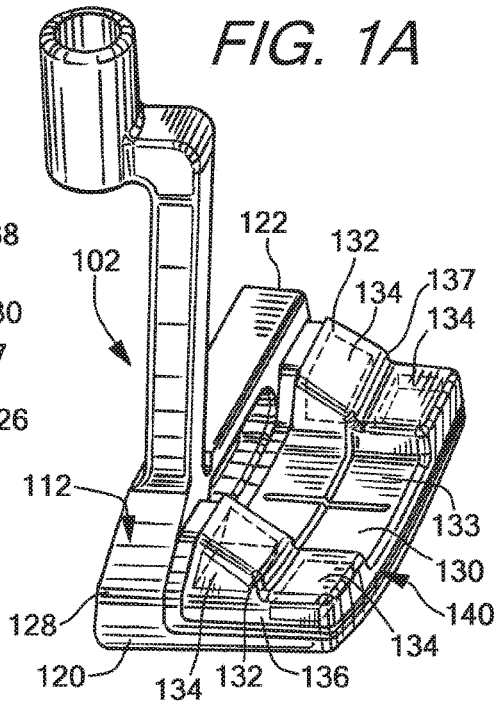
FIG. 1A is a top rear perspective view of another embodiment of a ball striking device according to aspects of the present invention, in the form of a golf putter.

The rear member 130 may be connected to the face member 128 in a number of different configurations that permit energy and/or momentum transfer between the rear member 130 and the face member 128, several of which are described below and shown in the FIG. 1*n* other embodiments, the rear member 130 may be differently configured, and/or the head 102 may contain multiple rear members 130. For example, the rear member 130 as shown in FIGS. 1-14 may be divided into two, three, or more separate rear members 130 in another embodiment, which may be connected to the face member 128 in similar or different configurations. The rear member 130 in all embodiments may affect or influence the center of gravity of the head 102. Additionally, the rear member 130 (and other weight members described herein) may be made of any of a variety of different materials, which may be selected based on their weight or density. For example, the rear member 130 may be made from a metallic material such as stainless steel and/or tungsten, or may be made from other materials, for example polymers that may be doped with a heavier material (e.g. tungsten). The rear member 130 may also include portions that may be more heavily weighted than others, and may include weighted inserts or other inserts. FIG. 1A illustrates one embodiment where the rear member 130 has weights 134 in the perimeter weighting portions 132, which are illustrated in this embodiment to be cavities that are filled with a weighting material, such as a polymer material doped with tungsten or other heavy material. The weights 134 may be in a different form in another embodiment, such as removable weights.

Figure 3:
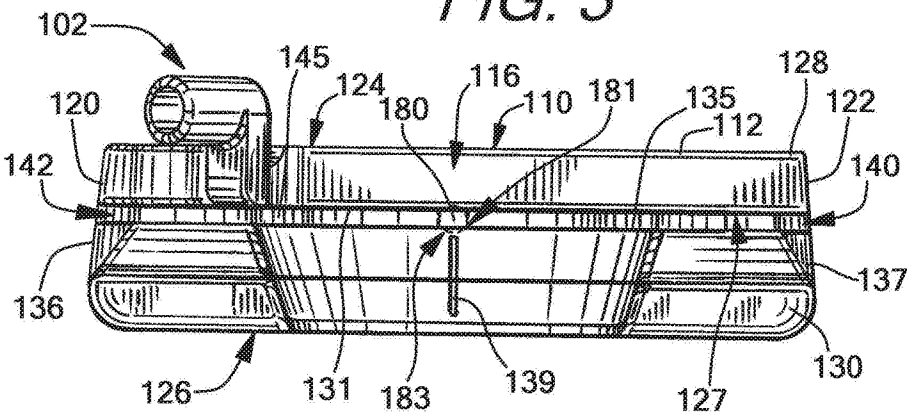
FIG. 3 is a top view of the ball striking device of FIG. 1.

In the embodiment of FIGS. 1-3, the rear member 130 is separated from the face member 128 by a resilient member 145 at least partially formed of the resilient material 140. In this embodiment, the rear member 130 may be considered to be suspended with respect to the face member 128, at least partially by the resilient material 140 in this configuration. It is understood that an adhesive or other bonding material may be utilized to connect the resilient material 140 to the face member 128 and/or the rear member 130, and that other connection techniques may be used in other embodiments, such as mechanical fasteners, interlocking designs (e.g. dovetail, tab and slot, etc.) and others. The resilient material 140 may be connected to the face member 128, the rear member 130, or both, in various embodiments. The resilient material 140 may be a natural or synthetic rubber material, a polyurethane-based elastomer, or other elastomeric material in one embodiment, but may be a different type of resilient material in another embodiment, including various types of resilient polymers, such as foam materials or other rubber-like materials. Additionally, the resilient material 140 may have at least some degree of resiliency, such that the resilient material 140 exerts a response force when compressed, and can return to its previous state following compression. The resilient material 140 may have a strength or hardness that is lower than, and may be significantly lower than, the strength/hardness of the material of the face member 128 and/or the rear member 130. In one embodiment, the resilient material 140 may have a hardness of from 30-90 Shore A or approximately 30-90 Shore A. In another embodiment, the resilient material 140 may have a hardness of approximately 50-70 Shore A. The hardness may be determined, for example, by using ASTM D-2240 or another applicable test with a Shore durometer. In an example embodiment, the resilient material 140 may be a polyurethane-based elastomer with a hardness of approximately 65 Shore A. Further, in one embodiment, the resilient material may have compression properties (based on a 0.56 shape factor and determined using ASTM D-575) as follows: 30 psi for 5% deflection, 70 psi for 10% deflection, 110 psi for 15% deflection, 160 psi for 20% deflection, and 220 psi for 25% deflection. Still further, the resilient material 140 may be any material described in U.S. Patent Application Publication No. 2013/0137533, filed Nov. 30, 2011, which application is incorporated by reference herein in its entirety and made part hereof.

The properties of the resilient material, such as hardness and/or resiliency, may be designed for use in a specific configuration. For example, the hardness and/or resiliency of the resilient material 140 may be designed to ensure that an appropriate rebound or reaction force is transferred to the face, which may be influenced by parameters such as material thickness, mass of various components (including the rear member 130 and/or the face member 128), intended use of the head 102, and others. The hardness and resiliency may be achieved through techniques such as material selection and any of a variety of treatments performed on the material that can affect the hardness or resiliency of the resilient material, as discussed elsewhere herein. The hardness and thickness of the resilient material may be tuned to the weight of a particular rear member 130. For example, heavier weights may require harder resilient material 140, and lighter weights may require softer resilient material 140. Using a thinner resilient material 140 may also necessitate the use of a softer material, and a thicker resilient material 140 may be usable with harder materials. In a configuration where the resilient material 140 is a polyurethane-based material having a hardness of approximately 65 Shore A, the resilient material 140 may have a thickness between the rear member 130 and the rear surface 131 of the face member 128 of approximately 5 mm in one embodiment, or approximately 3 mm in another embodiment.

In the embodiment shown in FIGS. 1-14, the resilient member 145 may be formed as a single, integral piece of the resilient material 140; however, the resilient member 145 may be formed of separate pieces in various embodiments. The resilient member 145 and/or the resilient material 140 may be formed of multiple components as well, including components having different hardness in different regions, including different hardness distributions. For example, the resilient member 145 and/or the resilient material 140 may be formed of an exterior shell that has a different (higher or lower) hardness than the interior, such as through being made of a different material (e.g. through co-molding) and/or being treated using a technique to achieve a different hardness. Examples of techniques for achieving a shell with a different hardness include plasma or corona treatment, adhesively bonding a film to the exterior, coating the exterior (such as by spraying or dipping). If a cast or other polyurethane-based material is used, the resilient material 140 may have a thermoplastic polyurethane (TPU) film bonded to the exterior, a higher or lower hardness polyurethane coating applied by spraying or dipping, or another polymer coating (e.g. a thermoset polymer), which may be applied, for example, by dipping the resilient material into an appropriate polymer solution with an appropriate solvent. Additionally, the resilient member 145 and/or the resilient material 140 may have different hardness or compressibility in different lateral or vertical portions thereof, which can create different energy and/or momentum transfer effects in different locations. For example, the resilient member 145 and/or the resilient material 140 may have a higher or lower hardness in proximate the heel 120 and/or the toe 122, which may be achieved by techniques described herein, such as treatments or use of different materials and/or separate pieces. In this configuration, the hardness of the resilient material 140 may be customized for use by a particular golfer or a particular golfer's hitting pattern. Similarly, an asymmetrical resilient member 145 may also be used to create different energy and/or momentum transfer effects, by providing a larger or smaller amount of material at specific portions of the face member 128. Such an asymmetrical resilient member 145 may also be used to provide customizability. A variable-hardness or asymmetrical resilient member 145 may also be used in conjunction with an offset connection point, as discussed below, for further customizability. Other embodiments described herein may also employ a resilient material 140 that has a variable hardness or asymmetrical features. A single-component or multi-component resilient member 145 and/or resilient material 140 may be manufactured by co-molding, and may be co-molded in connection with the face member 128 and/or the rear member 130.

As seen in FIGS. 1-14, the resilient material 140 is connected between the rear member 130 and the face member 128. In one embodiment, the rear member 130 has at least one surface that is engaged by the resilient material 140 and at least one other surface that is exposed and not engaged by the resilient material 140. In the embodiment of FIGS. 1-14, the front surface 135 and the underside 138 of the rear member 130 are engaged by the resilient material 140, and the top side and rear side of the rear member 130 are exposed and not engaged by the resilient material 140. As shown in FIG. 11, the resilient material 140 is sandwiched between the rear surface 131 on the rear side 127 of the face member 128 and the front surface 135 of the rear member 130 and is also sandwiched between the top surface 162 of the sole portion 161 and the underside 138 of the rear member 130. The rear member 130 is spaced from the face member 128, and the resilient material 140 at least partially fills the spaces 142 between the front surface 135 of the rear member 130 and the rear side 127 of the face member 128 and between the top surface 162 of the sole portion 161 and the underside 138 of the rear member 130. In the embodiment illustrated in FIGS. 1-14, the resilient material 140 is substantially flush with the outer peripheries of the face member 128 and the rear member 130 around the entire periphery of the head 102. In other embodiments, the face member 128, the rear member 130, and/or the resilient material 140 (or portions of such members) may not be flush or substantially flush around at least a portion of the periphery of the head 102. The resilient material 140 may be positioned on both opposite lateral sides of the center of gravity (CG) of the face member 128. In one embodiment, as shown in FIG. 11, the resilient material 140 completely or substantially completely fills the spaces 142 between the rear member 130 and the face member 128. In another embodiment, may have a resilient material 140 that partially fills the spaces 142 between the face member 128 and the rear member 130, such as the resilient material 140 being positioned between the face member 128 and the rear member 130 at least at the heel 120 and the toe 122.

The rear member 130 may have various different dimensions and structural properties in various embodiments. In the embodiment shown in FIGS. 1-14, the rear member 130 has a heel edge 136 and a toe edge 137, with a lateral width defined between the heel and toe edges 136, 137. The lateral width of the rear member 130 is the same or approximately the same as the lateral width of the face member 128, measured between the heel 120 and toe 122. Additionally, the rear member 130 has its mass distributed proportionally more toward the heel and toe edges 136, 137, and has a thickness and a cross-sectional area that are greater at or around the heel and toe edges 136, 137 than at the CG of the rear member 130. In other words, the rear member 130 includes two perimeter weighting portions 132 at the heel and toe edges 136, 137 and a recessed portion or thinned portion 133 proximate the center of the rear member. This configuration can achieve greater perimeter weight distribution and increased moment of inertia for the club head 102. Further, the rear member 130 may be positioned so that the CG of the rear member 130 is substantially aligned with the CG of the face member 128. In one embodiment, the CGs of the rear member 130 and the face member 128 are laterally aligned, and these respective CGs may additionally or alternately be vertically aligned in another embodiment. In one embodiment, the face member 128 may have alignment indicia aligned with the CG of the face member 128 and/or the CG of the rear member 130, however this indicia may be absent or differently located in other embodiments. The indicia may be formed by a groove 139 in the rear member 130 in one embodiment, such as in the embodiment illustrated in FIG. 3, where the groove 139 extends completely through the rear member 130 and exposes a portion of the resilient material 140. As described above, the resilient material 140 may be a highly visible color in one embodiment, which highlights this indicia.

The rear member 130 may have varying sizes in different embodiments. For example, in one embodiment, the rear member 130 may make up about 25% or more of the total weight of the head 102, or about 25-45% of the total weight of the head 102 in another embodiment. In an example embodiment, the total weight of the head 102 may be about 340 g, with the rear member 130 having a weight of about 100 g.

In certain example embodiments, the face member 128 and the rear member 130 may be connected together by one or more connection members 170. In the embodiment of FIGS. 1-14, the head 102 includes two connection members 170, which are in the form of screws or other threaded members. In other embodiments, different types of connection members 170 may be used, such as other fasteners, clips, tabs, complementary interlocking structures, etc. Additionally, in one embodiment, the connection member(s) 170 may connect the face member 128 and the rear member 130 in an arrangement such that the connection member(s) are only directly and/or rigidly engaged with one of the face member 128 and the rear member 130. In this configuration, the connection member(s) 170 may be separated from the other of the face member 128 and the rear member 130 by one or more flexible members such as spacers 171, such that the connection member(s) 170 indirectly engage the other of the face member 128 and the rear member 130. In one embodiment, the connection member(s) 170 may compress the spacer(s) 171 against the face member 128 or the rear member 130, in order to create an indirect, non-rigid engagement with such member. The connection member(s)

170 may each be received in openings in the face member 128 and the rear member 130 in one embodiment, to connect the face member 128 to the rear member 130. In the embodiment illustrated in FIGS. 1-14, the connection members 170 both directly and rigidly engage the rear member 130 and indirectly engage the face member 128 due to the presence of the spacers 171. However, this arrangement may be transposed in another embodiment, such that one or both of the connection members 170 directly and rigidly engage the face member 128 and not the rear member 130. Further, in the embodiment of FIGS. 1-14, the connection members 170 are positioned proximate the heel and toe of the club head 102, and are spaced relatively equal distances from the CG of the rear member 130 and the face member 128. In further embodiments, the number and/or arrangement of connection members 170 may be different.

As described above, the connection members 170 in the embodiment of FIGS. 1-14 are in the form of threaded fasteners. In this configuration, each connection member 170 has an enlarged head 172 and a shaft 177 extending from the head 172. The shaft 177 has at least a portion that is threaded for complementary engagement with other threaded structures, such as in the rear member 130 as described below. In a threaded configuration, the connection members 170 may be configured for removable connection, to allow for interchanging of the rear member 130 and/or the face member 128. The head 172 of each connection member 170 may be configured for engagement by a tool, such as seen in FIG. 5. The connection members 170 may have different configurations in other embodiments. Additionally, the connection members 170 may function as weight members for influencing the weighting configuration (e.g., CG, MOI, etc.) of the club head 102. It is noted that in the configuration shown in FIGS. 1-14, the connection members 170 are directly connected to the rear member 130, and thus, operate as part of the rear member 130 for weighting purposes. For this functionality, the connection members 170 may have different weight characteristics in one embodiment, such as different densities and/or geometries, to provide different weighting configurations. Each connection member 170 may also be removable and interchangeable with another connection member 170 having a different weighting characteristic. For example, the connection members 170 can be used to shift the CG of the rear member 130 and/or the entire head 102 toward the heel 120 or the toe 122, or can be used to increase or decrease the overall weight of the rear member 130 and/or the entire head 102, among other uses. In one embodiment, the use of the connection members 170 to alter the weight of the rear member 130 allows the ratio between the weights of the face member 128 and the rear member 130 to be controlled. Further weighting configurations are recognizable to those skilled in the art.

The spacer 171 may be made of a variety of different materials, and may be relatively flexible in one embodiment. For example, the spacer 171 may be made of a polyurethane material, or any other material described above with respect to the resilient material 140. In one embodiment, the spacer 171 may be made of the same resilient material as the resilient member 145. The spacer 171 in FIGS. 1-14 has a base 175 with an opening 176 that permits the connection member 170 to pass through, and one or more walls 173 that extend transverse or perpendicular to the base 175, as shown in FIGS. 4 and 6. The spacer 171 may have a notch 174 or other hollowed area in the wall 173 in order to increase the flexibility of the wall 173, as shown in FIG. 6. It is understood that the spacer 171 may have different configurations in other embodiments. Further, the spacer 171 may generally be considered to be a flexible material positioned between the connection member 170 and the face member 128 (or the rear member 130 in a transposed embodiment). In an alternate embodiment, the spacer 171 may not be a separate piece, and may be formed by a flexible material coating a portion of the connection member 170 and/or a portion of the face member 128 adjacent the connection member 170. In a further embodiment, the head 102 may have no resilient material 140 between the face member 128 and the rear member 130, and the spacer(s) 171 may form a non-rigid connection between the face member 128 and the rear member 130.

In the embodiment of FIGS. 1-14, the face member 128 includes openings 164 that permit the connection members 170 to pass through to connect to the rear member 130. These openings 164 are positioned in the sole portion 161 and extend upwardly through the sole portion 161 in the embodiment of FIGS. 1-14, however the positioning and orientation of these structures may be different, such as in a club head 102 where the structure, orientation, and/or arrangement of the face member 128 and the rear member 130 are different. In one embodiment, as shown in FIG. 11, a shoulder 166 may be defined around at least a portion of each opening 164, such that the connection member 170 (e.g., the head 172) compresses the base 175 of the spacer 171 against the shoulder 166. This compression creates an indirect, non-rigid engagement between the connection member 170 and the face member 128. Cavities 165 may be defined around at least part of the openings 164, in order to receive the heads 172 of the connection members 170, as well as the spacers 171. Such cavities 165 may be defined as recesses in the sole portion 161, in one embodiment. The cavities 165 may also define the shoulder 166 therein, as shown in FIGS. 6 and 12. Further, the cavities 165 in the embodiment of FIGS. 1-14 define side walls 167 that may also be engaged by the spacers 171. As shown in FIG. 11, the wall 173 of each spacer 171 extends between the head 172 of the connection member 170 and the side wall 167 of the cavity 165. This configuration permits the spacer 171 to absorb lateral forces (i.e., in the front-rear and/or heel-toe directions) as the head 172 compresses the wall 173 of the spacer 171 against the side wall 167. In the embodiment of FIGS. 1-14, each cavity 165, including the shoulder 166 and the side wall 167, is defined by a cylindrical projection 168 that projects upward from the top side 162 of the sole portion 161. This projection 168 may interlock with cooperatively dimensioned structures in the rear member 130 and/or the resilient member 145, as described herein. In another embodiment, each cavity 165 may be formed by a recess in the face member 128 that is not deeper than the thickness of the face member 128 at that location. In a further embodiment, no cavities 165 may be present.

In one embodiment, the rear member 130 has one or more receivers 178 that are configured to receive and engage the connection member(s) 170. The rear member 130 in the embodiment of FIGS. 1-14 has two receivers 178, one proximate the heel edge 136 and one proximate the toe edge 137. As shown in FIG. 11, the receiver(s) 178 may be configured to directly and rigidly engage the connection member(s) 170 in one embodiment. For example, in the embodiment of FIGS. 1-14, each receiver 178 is threaded to engage the threaded shaft 177 of the respective connection member 170 in a direct and rigid manner. Other types of direct and rigid connections may be used in other embodiments, including different types of mechanical connections such as interference or friction fit or complementary interlocking structures such as tabs, slots, etc., bonding (e.g., adhesives), welding, or other integral joining techniques, and other suitable connections. The receivers 178 in the embodiment of FIGS. 1-14 are formed by openings or recesses in the underside 138 of the rear member 130. Additionally, the receivers 178 are generally aligned with the openings 164 of the face member 128, to permit the connection members 170 to extend upwardly through the openings 164 and into the receivers 178 to engage the receivers 178. In one embodiment, as shown in FIG. 11, the rear member 130 further has recessed channels 179 surrounding the receivers 178 on the underside 138 of the rear member 130, and at least a portion of each of the cylindrical projections 168 of the face member 128 is received within the respective channels 179. Accordingly, in this embodiment, the width (e.g., the diameter) of each cylindrical projection 168 is greater than the width of the respective receiver 178 and smaller than the width of the respective channel 179. Further, the resilient material 140 may have portions 143 that are also received within each channel 179, to separate the projections 168 from the rear member 130. As seen in FIG. 4, these portions 143 of the resilient material 140 may surround one or more openings 141 to permit the connection member(s) 170 to pass through. These portions 143 of the resilient material 140 may engage the channel 179 and/or the projections 168, and in the embodiment of FIGS. 1-14, these portions 143 are in the form of cylindrical projections having an inner width that is approximately equal (i.e. slightly larger) than the outer width of the projections 168 of the face member 128. In other embodiments, the receivers 178 and associated structures may be differently configured based at least in part on the configuration of the connecting member(s) 170.

It is understood that the numbers, orientations, and/or locations of the openings 164, receivers 178, and connection members 170 may be different in other embodiments, and that the numbers of such components may all be equal. It is also understood that while the openings 164, the receivers 178, the connection members 170, and components thereof and other associated structures are all illustrated as being circular, one or more of such structures may be non-circular in one embodiment (e.g., square, hexagonal, octagonal, etc.).

In one embodiment, the club head 102 may include an engagement member 180 that rigidly engages both the face member 128 and the rear member 130 to form a point of rigid engagement 181 between the face member 128 and the rear member 130. The engagement member 180 may be the sole point or area of rigid engagement between the face member 128 and the rear member 130 in one embodiment. For example, in the embodiment of FIGS. 1-14, the engagement member 180 forms the sole area of rigid engagement between the face member 128 and the rear member 130, as the resilient material 140 separates the face member 128 from the rear member 130, and the spacers 171 prevent rigid engagement through the connection members 170. In other embodiments, there may be multiple areas of rigid engagement between the face member 128 and the rear member 130, such as by use of multiple engagement members 180, or there may be no points of rigid engagement between the face member 128 and the rear member 130, such as if the club head 102 is not provided with an engagement member. It is understood that "rigid" engagement as defined herein does not necessary imply any fixing or attachment, but instead, means that the surfaces engaging each other are rigid, rather than flexible, and behave rigidly during energy and/or momentum transfer. For example, the engagement member 180 illustrated in FIGS. 7 and 11 may rigidly engage the face member 128 and/or the rear member 130 through non-fixed abutment.

The engagement member 180 may have various structural configurations, locations, and orientations. In one embodiment, the engagement member 180 may be made from a material with a greater hardness than the resilient material 140, such as a metal, ceramic, or hard polymer or FRP material. In various embodiments, the engagement member 180 may be fixed to at least one of the face member 128 and the rear member 130, and/or the engagement member may rigidly abut at least one of the face member 128 and the rear member 130 (but without being fixedly connected). In the embodiment illustrated in FIGS. 7 and 11, the engagement member 180 is a domed projection that is fixed to the rear surface 131 of the face member 128 (i.e., the rear of the face portion 160) and abuts the front surface 135 of the rear member 130, but the engagement member 180 is not fixed or otherwise connected to the rear member 130. In this embodiment, the resilient material 140 includes a gap 144 allowing the engagement member 180 to extend through the resilient material 140 to engage both the face member 128 and the rear member 130. Additionally, in this embodiment, the engagement member 180 is located approximately at a midpoint between the heel and toe 120, 122 and also approximately at a midpoint between the heel and toe edges 136, 137 of the rear member 130. In this location, the engagement member 180 and the joint 183 also approximately aligned laterally with the CG of the face member 128, the rear member 130, and/or the club head 102 as a whole. The engagement member 180 may also be vertically aligned with the CG of one or more of these components, in a further embodiment. In other embodiments, the engagement member 180 may have a different orientation, structure, or location. In a further embodiment, the engagement member 180 may not be fixed to either the face member 128 or the rear member 130, but may instead be part of the resilient member 145 and/or at least partially embedded within the resilient member 145, as shown in FIG. 6A. This engagement member 180 may be formed, in one example, by co-molding the resilient material 140 with the engagement member 180.

Figure 8:
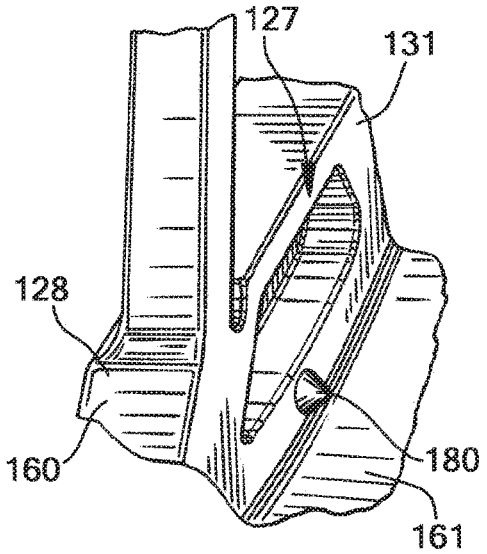
FIG. 8 is a magnified view of a portion of a face member of another embodiment of a ball striking device according to aspects of the present invention, in the form of a golf putter.

FIGS. 8-10 and 13-14 illustrate potential alternate embodiments of the engagement member 180 that may be used in connection with the club head 102 shown in FIGS. 1-6 and 11-12, and it is understood that any of the engagement members 180 described herein may be utilized with any embodiments of club heads 102 described herein. In the embodiment of FIG. 8, the engagement member 180 is in the form of a conical member that extends rearwardly from the rear surface 131 of the face member 128. The engagement member 180 in this embodiment is located in generally the same position as the engagement member 180 in FIG. 7, as described above.

Figure 9:
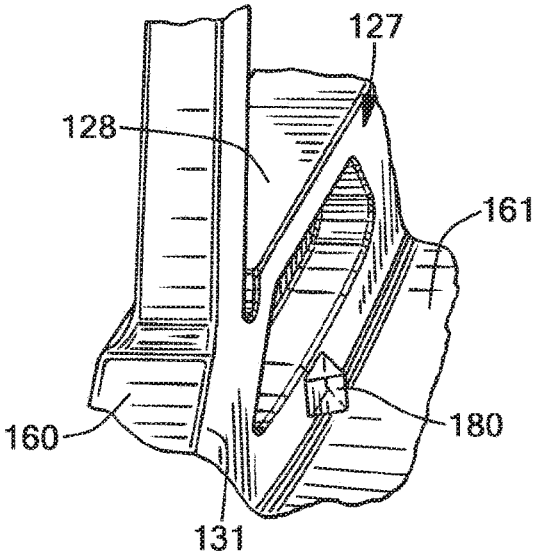
FIG. 9 is a magnified view of a portion of a face member of another embodiment of a ball striking device according to aspects of the present invention, in the form of a golf putter.

In the embodiment of FIG. 9, the engagement member 180 is in the form of a triangular wedge-shaped member, with a vertical leading edge, that extends rearwardly from the rear surface 131 of the face member 128. The engagement member 180 in this embodiment is located in generally the same position as the engagement member 180 in FIG. 7, as described above.

Figure 10:
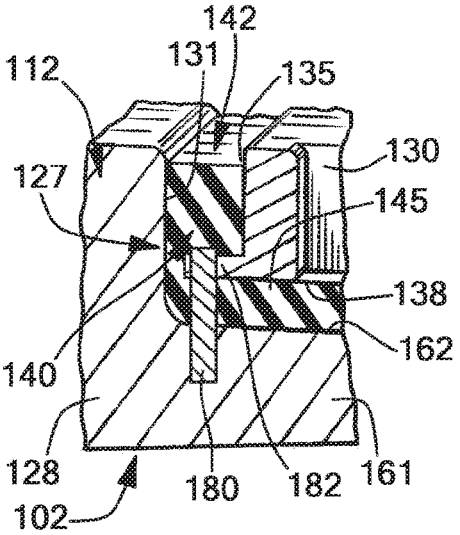
FIG. 10 is a magnified cross-section view of a portion of another embodiment of a ball striking device according to aspects of the present invention, in the form of a golf putter.

In the embodiment of FIG. 10, the engagement member 180 is in the form of a pin that is fixedly connected to the sole portion 161 of the face member 128 and extends upwardly from the top surface 162 of the sole portion 161 proximate the face portion 160. The engagement member (pin) 180 in this embodiment is received within a receiver 184 in the rear member 130 and is non-fixedly connected to the rear member 130. The rear member 130 may include a projection 182 that extends forward from the front surface 135 of the rear member 130, which includes the receiver 184 in one embodiment, as shown in FIG. 10.

Figure 13:
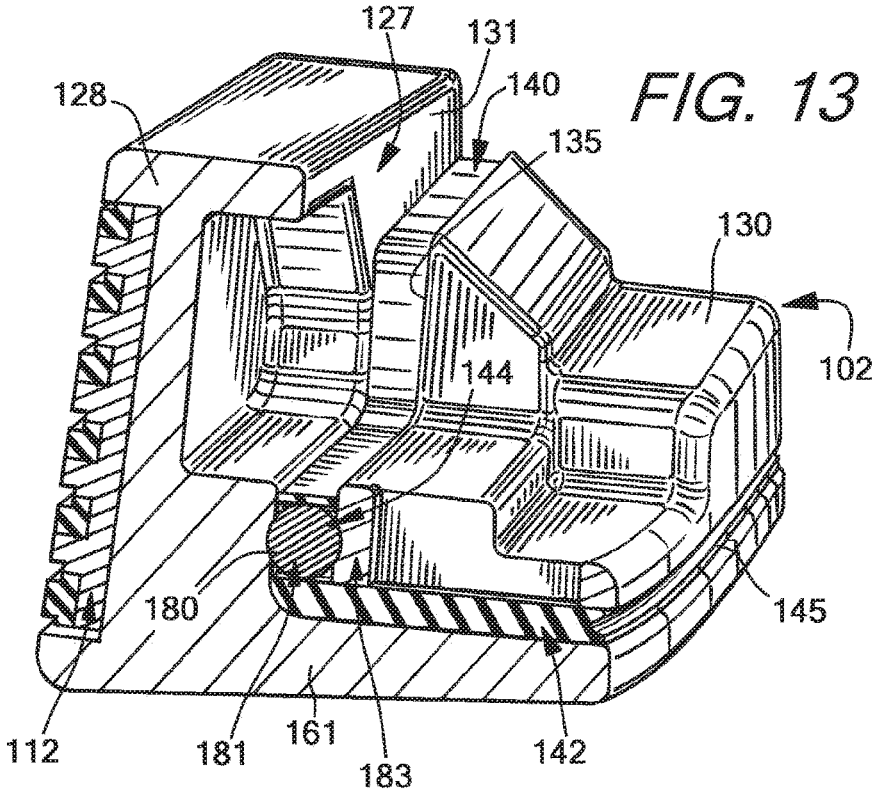
FIG. 13 is a cross-section view of another embodiment of a ball striking device according to aspects of the present invention, in the form of a golf putter.

In the embodiment of FIG. 13, the engagement member 180 is in the form of a sphere (e.g., a ball bearing) that is not fixedly connected to either the rear surface 131 of the face member 128 or the front surface 135 of the rear member 130. Instead, this engagement member 180 abuts both of these surfaces. The engagement member 180 in this embodiment is located in generally the same position as the engagement member 180 in FIG. 7, as described above.

Figure 14:
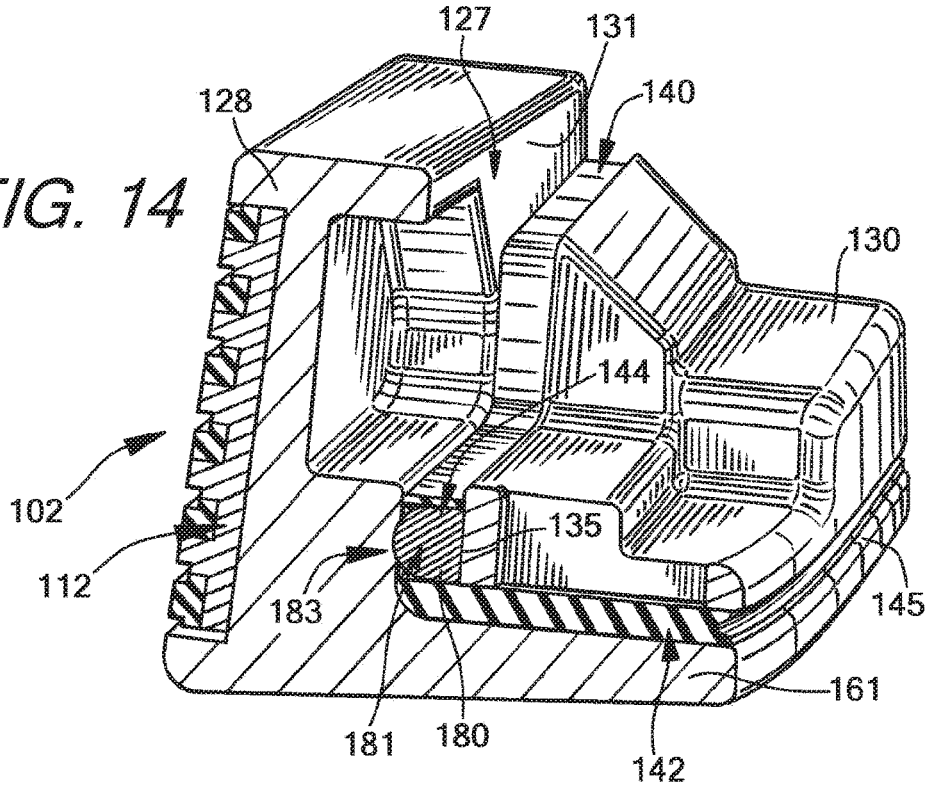
FIG. 14 is a cross-section view of another embodiment of a ball striking device according to aspects of the present invention, in the form of a golf putter.
Figure 15:
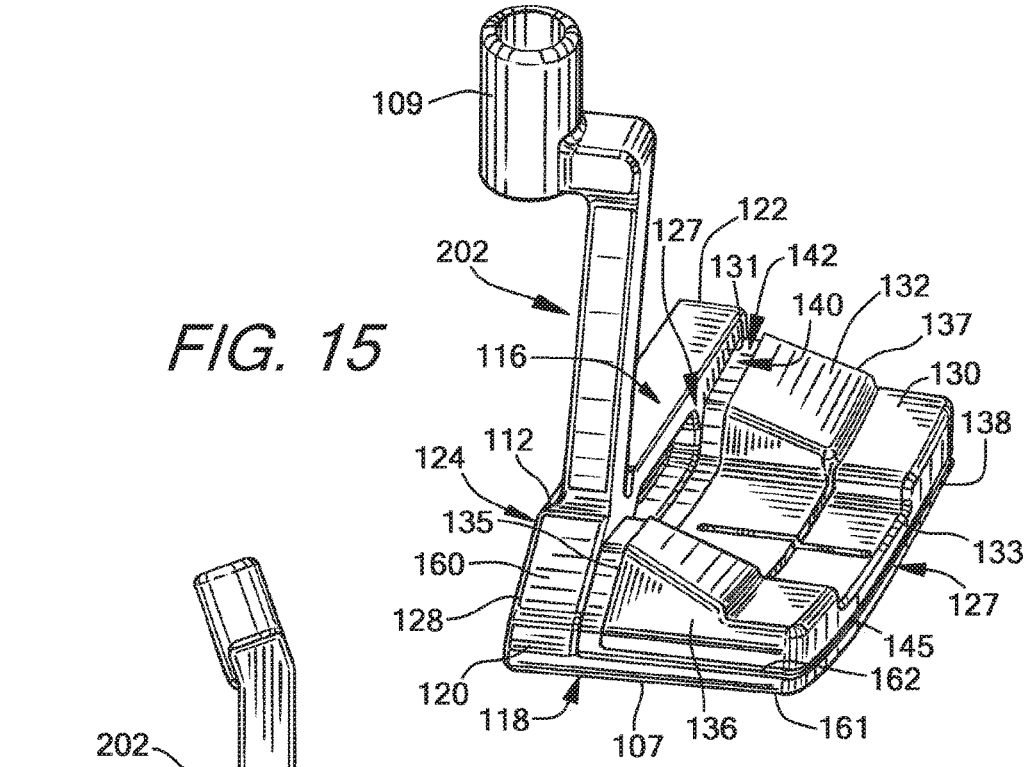
FIG. 15 is a top rear perspective view of another embodiment of a ball striking device according to aspects of the present invention, in the form of a golf putter.
Figure 16:
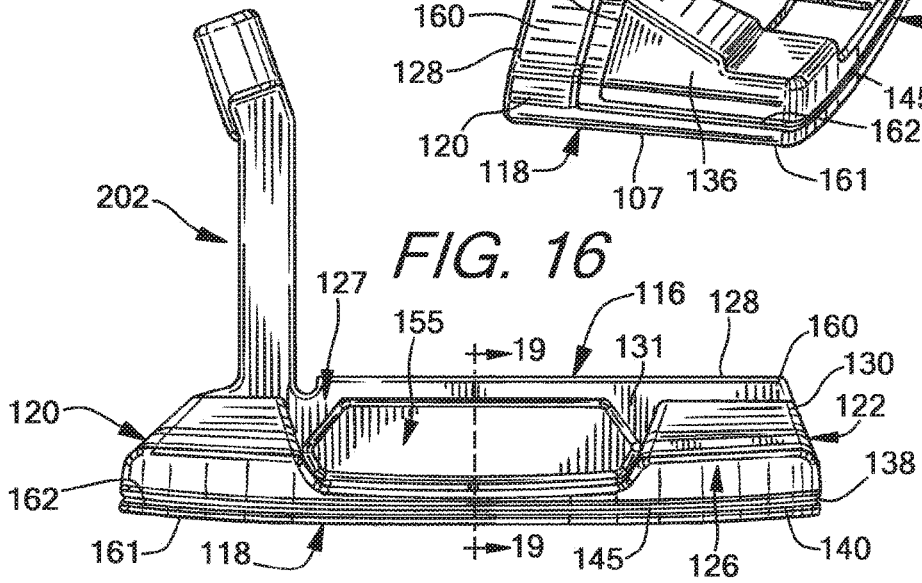
FIG. 16 is a rear view of the ball striking device of FIG. 15.
Figure 17:
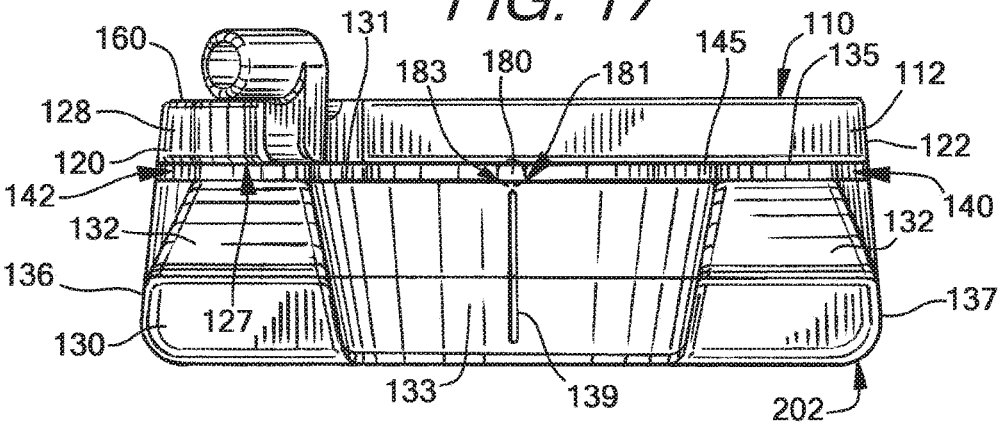
FIG. 17 is a top view of the ball striking device of FIG. 15.
Figure 18:
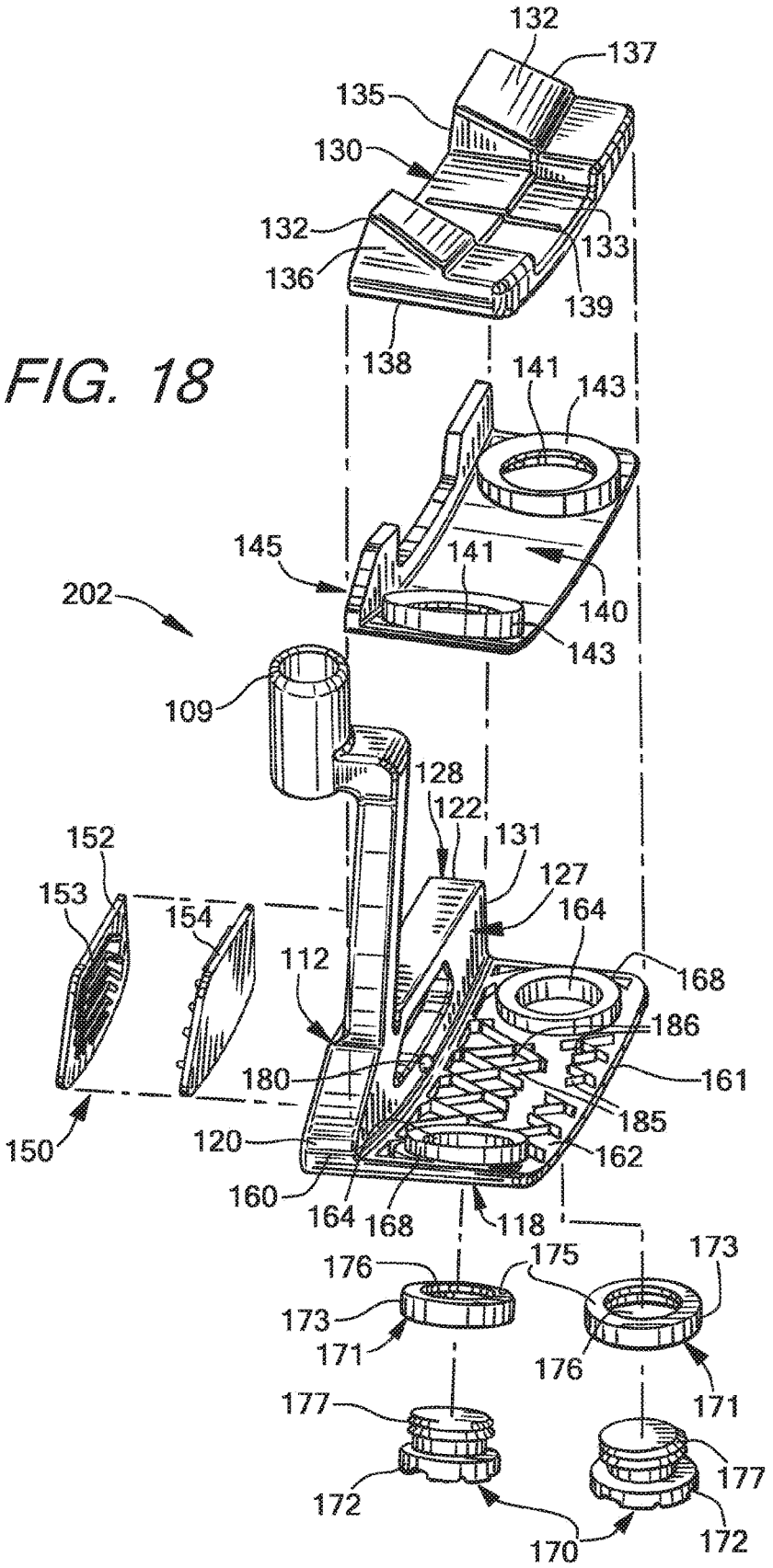
FIG. 18 is a top rear perspective exploded view of the ball striking device of FIG. 15.
Figure 19:
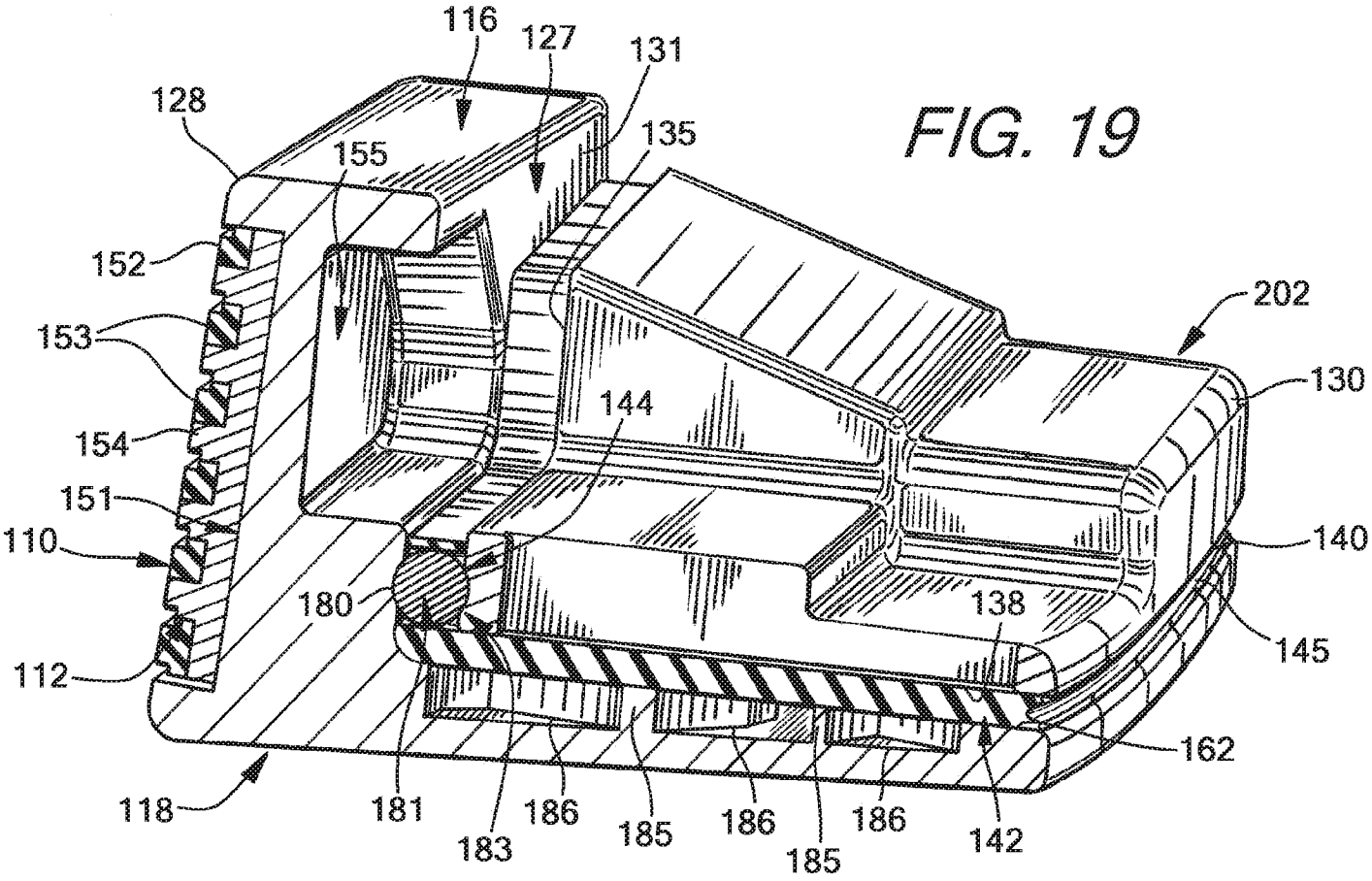
FIG. 19 is a cross-section view taken along line 19-19 in FIG. 16.

In the embodiment of FIG. 14, the engagement member 180 is in the form of a domed projection that is fixed to the front surface 135 of the rear member 130 and abuts (but is not fixedly connected to) the rear surface 131 of the face member 128. The engagement member 180 in this embodiment is located in generally the same position as the engagement member 180 in FIG. 7, as described above, and may generally be regarded as a transposed version of the embodiment of FIG. 7.

Additional configurations of engagement members 180 may be utilized in other embodiments. It is understood that the locations of any of the engagement members 180 in FIGS. 8-10 and 13-14 may be transposed, such that the engagement member 180 is fixed to the rear member 130 and is not fixedly connected to the face member 128. Further, the engagement members 180 in FIGS. 7-11 and 13-14 may be considered to define a joint 183 between the face member 128 and the rear member 130, in one embodiment.

The rear member 130 may be configured such that energy and/or momentum can be transferred between the rear member 130 and the face member 128 during impact, including an off-center impact on the striking surface 110. The resilient material 140 can serve to transfer energy and/or momentum between the rear member 130 and the face member 128 during impact. Additionally, the rear member 130 may also be configured to resist deflection of the face member 128 upon impact of the ball on the striking surface 110. The resiliency and compression of the resilient material 140 and/or the spacer(s) 171 permits this transfer of energy and/or momentum from the rear member 130 to the face member 128. As described above, the momentum of the rear member 130 compresses the resilient material 140 and/or the spacer(s) 171, and causes the resilient material 140 and/or the spacer(s) 171 to exert a response force on the face member 128 to achieve this transfer of momentum. The resilient material 140 may exert at least a portion of the response force on the face member 128 through expansion after the compression. The rear member 130 may deflect slightly toward the impact point to compress the resilient material 140 and/or the spacer(s) 171 in the process of this momentum transfer. The actions achieving the transfer of momentum occur between the beginning and the end of the impact, which in one embodiment of a golf putter may be between 4-5 ms. In the embodiment as shown in FIGS. 1-14, the rear member 130 may transfer a greater or smaller amount of energy and/or momentum depending on the location of the impact on the striking surface 110. For example, in this embodiment, upon an off-center impact of the ball centered on the heel side 120, the face member 128 tends to deflect rearwardly at the heel 120. As another example, upon an off-center impact of the ball centered on the toe side 122, the face member 128 tends to deflect rearwardly at the toe 122. As the face member 128 begins to deflect rearwardly, at least some of the forward momentum of the rear member 130 is transferred to the face member 128 during impact to resist this deflection. In the embodiment of FIGS. 1-14, on a heel-side impact, at least some of the momentum transferred to the face member 128 may be transferred from the heel edge 136 of the rear member 130 during impact. Likewise, on a toe-side impact, at least some of the momentum transferred to the face member 128 may be transferred from the toe edge 137 of the rear member 130 during impact. Generally, at least some of the momentum is transferred toward the impact point on the face 112.

The resilient material 140 can function to transfer the energy and/or momentum of the rear member 130 to the face member 128 at the heel 120 or toe 122. In the process of transferring energy and/or momentum during impact, the resilient material 140 and/or the spacer(s) 171 may be compressed by the momentum of the rear member 130 and expand to exert a response force on the face member 128, which resists deflection of the face member 128 as described above. It is understood that the degree of potential moment causing deflection of the face member 128 may increase as the impact location diverges from the center of gravity of the face member 128. In one embodiment, the energy and/or momentum transfer from the rear member 130 to the face member 128 may also increase as the impact location diverges from the center of gravity of the face member 128, to provide increased resistance to such deflection of the face member 128. In other words, the energy and/or momentum transferred from the rear member 130 to the face member 128, and the force exerted on the face member 128 by the rear member 130, through the resilient material 140 and/or the spacer(s) 171, may be incremental and directly relative/proportional to the distance the impact is made from the optimal impact point (e.g. the lateral center point of the striking surface 110 and/or the CG of the face member 128, in exemplary embodiments). Thus, the head 102 will transfer the energy and/or momentum of the rear member 130 incrementally in the direction in which the ball makes contact away from the center of gravity of the head 102, via the rear member 130 suspended by the resilient material 140. The transfer of energy and/or momentum between the rear member 130 and the face member 128 can reduce the degree of twisting of the face 112 and keep the face 112 more square upon impacts, including off-center impacts. Additionally, the transfer of energy and/or momentum between the rear member 130 and the face member 128 can minimize energy loss on off-center impacts, resulting in more consistent ball distance on impacts anywhere on the face 112. The resilient material 140 and/or the spacer(s) 171 may have some elasticity or response force that assists in transferring energy and/or momentum between the rear member 130 and the face member 128.

Figure 20:
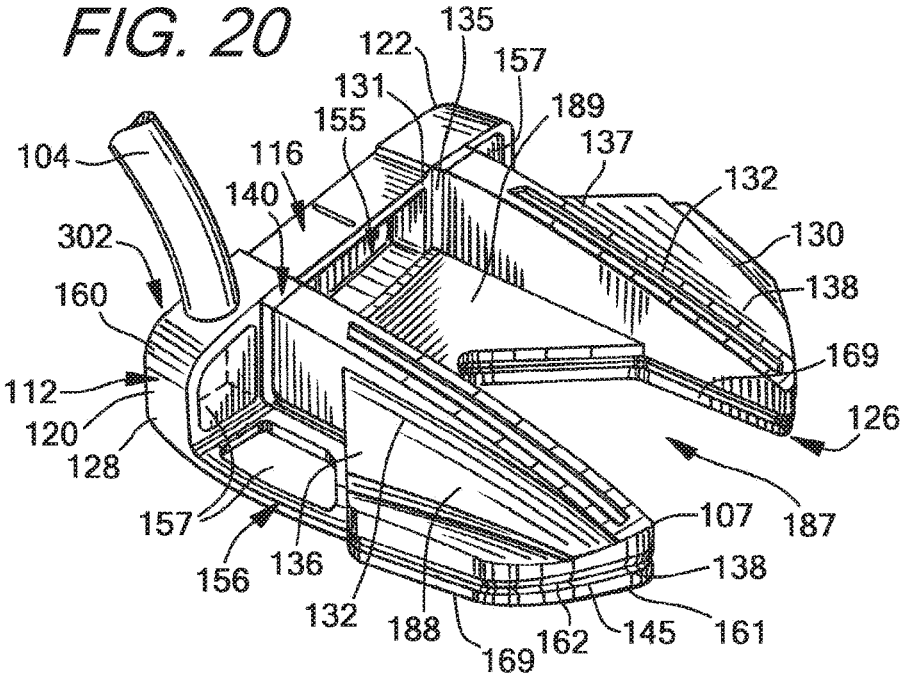
FIG. 20 is a top rear perspective view of another embodiment of a ball striking device according to aspects of the present invention, in the form of a golf putter.
Figure 21:
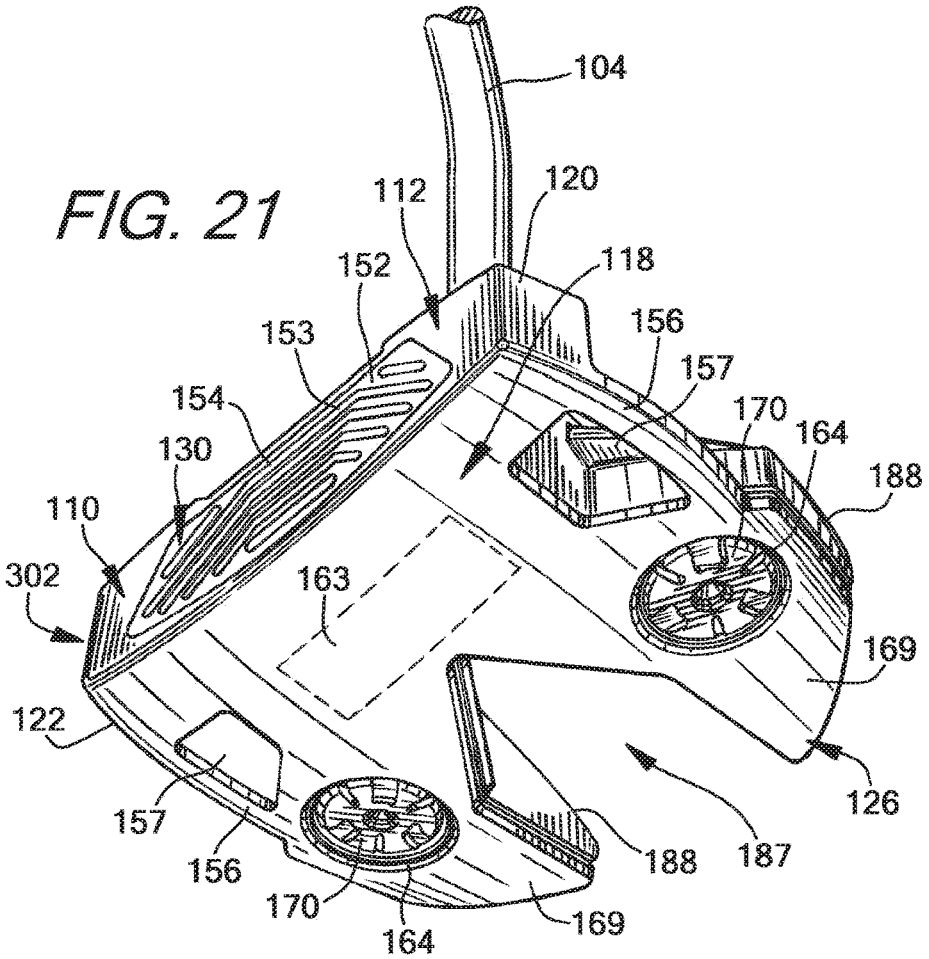
FIG. 21 is a front bottom perspective view of the ball striking device of FIG. 20.
Figure 22:
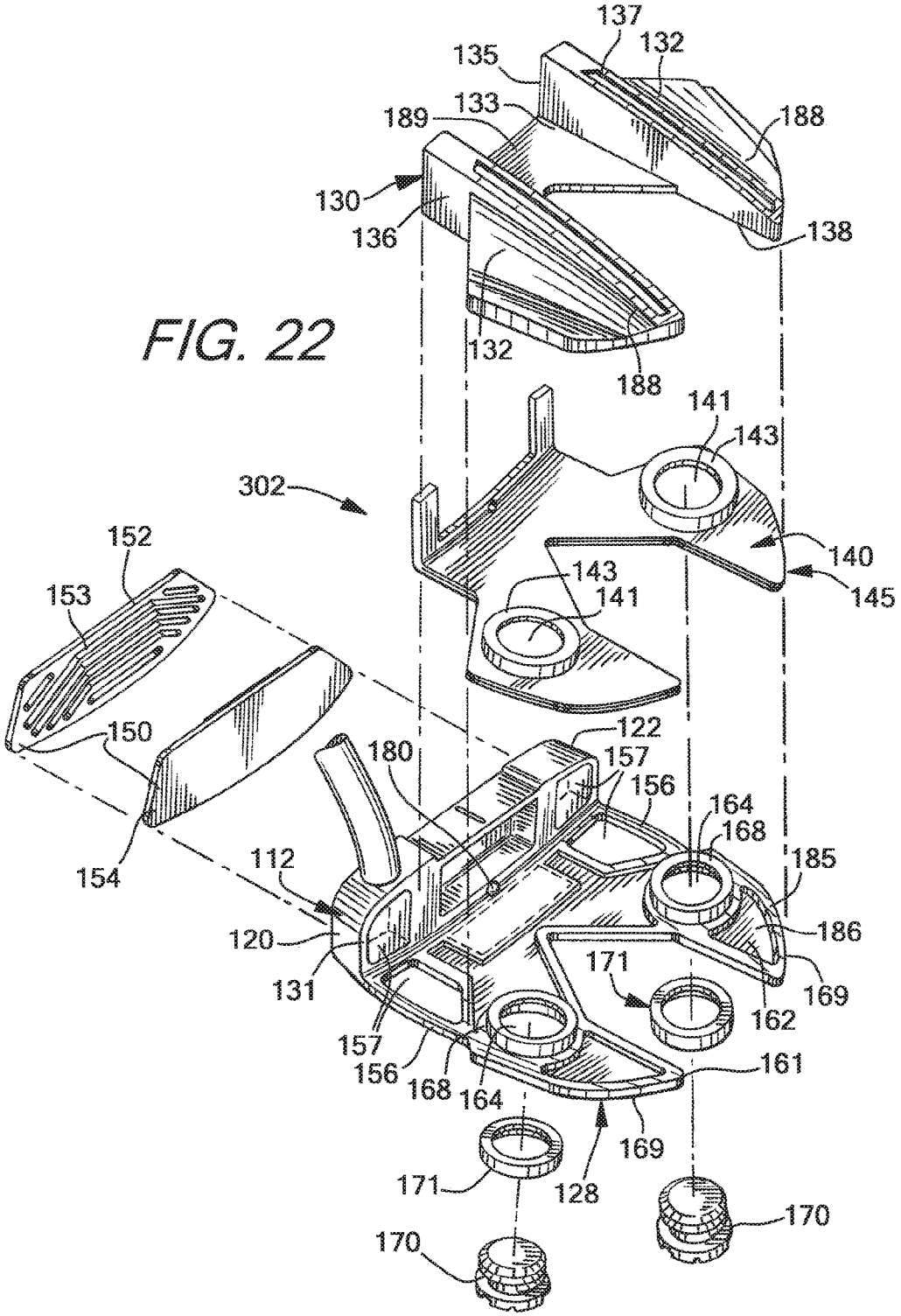
FIG. 22 is a top rear perspective exploded view of the ball striking device of FIG. 20.

FIGS. 15-19 illustrate another embodiment of a ball striking head in the form of a putter-type golf club head 202, which contains many components and features that are similar to the features described above with respect to the head 102 of FIGS. 1-14. FIGS. 20-22 illustrate a further embodiment of a ball striking head in the form of a putter-type golf club head 302, which contains many components and features that are similar to the features described above with respect to the head 102 of FIGS. 1-14. Such similar components of the heads 202, 302 are referred to by similar reference numbers in the description below and in the drawing figures. Description of some such components that have already been described above may be simplified or eliminated for the sake of brevity in the description below. Thus, the embodiments of FIGS. 15-22 are generally described herein with respect to the differences that exist between such club heads 202, 302 and the embodiment of FIGS. 1-14. The club heads 202, 302 of FIGS. 15-22 generally function in the same manner as described herein with respect to the head 102 of FIGS. 1-14. For example, the configurations of the heads 202, 302 in FIGS. 15-22 may achieve energy and/or momentum transfer between the rear member 130 and the face member 128 in a manner similar to that described herein with respect to the embodiment of FIGS. 1-14.

The club head 202 in the embodiment of FIGS. 15-19 is structurally similar to the club head 102 described above with respect to FIGS. 1-14, and generally includes all the features (including alternate embodiments) described herein with respect to FIGS. 1-14. One notable difference is that the club head 202 in FIGS. 15-19 has a face member 128 with a sole portion 161 that has a greater front-to-rear length as compared to the head 102 of FIGS. 1-14. The rear member 130 in the head 202 of FIGS. 15-19 has a similarly increased length, so that the face member 128 and the rear member 130 follow generally the same outer periphery. Additionally, the sole portion 161 of the face member 128 of the club head 202 in FIGS. 15-19 has a plurality of ridges or raised portions 185 on the top surface 162. This structure may additionally or alternately be viewed as having a plurality of recesses 186 on the top surface 162 of the sole portion 161. Further, the raised portions 185 and/or the recesses 186 may form a cellular structure. The recesses 186 may function to reduce the mass of the sole portion 161 and the overall mass of the face member 128, so that a greater proportion of the overall mass of the head 202 can be shifted to the rear member 130. In this configuration, the sole portion 161 in the head 202 of FIGS. 15-19 may have a mass that is the same or less than the smaller (but solid) sole portion 161 illustrated in FIGS. 4 and 11. In addition, the raised portions 185 may provide a more secure engagement surface for the resilient material 140, and in one embodiment (not shown), portions of the resilient material 140 may at least partially fill the recesses 186.

The club head 302 in the embodiment of FIGS. 20-22 has a face member 128 and a rear member 130 that are shaped differently from the face member 128 and the rear member 130 in the head 102 illustrated in FIGS. 1-14, creating a different outer peripheral shape. In the club head 302 illustrated in FIGS. 20-22, a void 187 is defined at a rear-central portion of the club head 302. The sole portion 161 of the face member 128 in this embodiment has two legs 169 that extend rearwardly from the face portion 160 and are spaced from each other. The rear member 130 is also configured with two legs 188 that extend rearwardly from a base portion 189 that confronts the rear surface 131 of the face member 128. The legs 188 of the rear member 130 are generally aligned and superimposed above the legs 169 of the face member 128, so that the face member 128 and the rear member 130 follow generally the same outer periphery, at least around the rear 126 of the club head 302. The legs 188 of the rear member 130 may further act as perimeter weighting portions 132 as described above, and the rear member 130 has a thinned portion 133 located between the legs 188, such that the mass of the rear member 130 is distributed proportionally to the legs 188. The resilient material 140 is configured to match the peripheries of the rear member 130 and the sole portion 161 of the face member 128 in this embodiment, and is further configured to cover portions of the rear surface 131 of the face member 128 that are confronted by the front surface 135 of the rear member 130. In the embodiment illustrated in FIGS. 20-22, the connection members 170, the openings 164, the receivers 178, the spacers 171, and other structures associated with these components are located in the legs 169, 188, with one connection member 170 connected to each corresponding set of legs 169, 188 (i.e., one on the heel side, one on the toe side). In another embodiment, these structures may be located within the base portion 189 of the rear member 130 and the aligned portions of the face member 128.

The void 187 is defined between the legs 169, 188 in the embodiment illustrated in FIGS. 20-22. The void 187 may have a V-shape or U-shape, which is narrower more proximate to the face 112 and wider at the rear 126 of the club head 302, such that the void 187 is open at the rear of the club head 302, as illustrated in FIGS. 20-22. In this configuration, the widths of the legs 169, 188 of the face member 128 and the rear member 130 taper toward the rear 126 of the club head 302, narrowing to points at the free ends thereof. In other embodiments, the void 187 may have a different shape or configuration, and the void 187 may be completely enclosed in one embodiment. The sole portion 161 of the face member 128 also has uncovered portions 156 that are not covered by the rear member 130 or the resilient material 140 in the embodiment illustrated in FIGS. 20-22. However in another embodiment, the entire top surface 162 of the sole portion 161 may be covered by the rear member 130 and/or the resilient material 140, as in the embodiment of FIGS. 1-14. The face member 128 may further include cavities 157 where material is removed to reduce the mass of the face member 128. The head 302 in FIGS. 20-22 has such cavities 157 located in the rear surface 131 of the face member 128 (in the face portion 160) and located in the uncovered portions 156 of the sole portion 161. The mass of the face member 128 is thereby reduced, enabling more mass to be located within the rear member 130. In addition, the head 302 of FIGS. 20-22 does not include a hosel structure extending from the face member 128 as in the embodiments of FIGS. 1-19. Instead, the embodiment in FIGS. 20-22 includes an internal hosel structure, such that the shaft 104 connects directly to the face member 128. The top surface 162 of the sole portion 161 also includes recesses 186, with raised portions 185 generally following the periphery of the resilient material 140, as seen in FIG. 22. Other components of the head 302 of FIGS. 20-22 are generally similar to the components of the head 102 described herein with respect to FIGS. 1-14.

It is understood that any of the embodiments of ball striking devices 100, heads 102, 202, 302, face members 128, rear members 130, and other components described herein may include any of the features described herein with respect to other embodiments described herein, including structural features, functional features, and/or properties, unless otherwise noted. It is understood that the specific sizes, shapes, orientations, and locations of various components of the ball striking devices 100 and heads 102, 202, 302 described herein are simply examples, and that any of these features or properties may be altered in other embodiments. In particular, any of the connecting members or structures shown and described herein may be used in connection with any embodiment shown herein, to connect the face member 128 and the rear member 130.

Heads 102, 202, 302 incorporating the features disclosed herein may be used as a ball striking device or a part thereof. For example, a golf club 100 as shown in FIG. 1 may be manufactured by attaching a shaft or handle 104 to a head that is provided, such as the head 102 as described above. As another example, a golf club 100 as shown in FIG. 1 may be manufactured by attaching a rear member 130 to a face member that is provided, such as the face member 128 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. In one embodiment, a set of golf clubs can be manufactured, where at least one of the clubs has a head according to one or more embodiments described herein. Such a set may include at least one wood-type club, at least one iron-type club, and/or at least one putter. For example, a set may include one or more wood-type golf clubs and one or more iron-type golf clubs, which may have different loft angles, as well as one or more putters, with each club having a head 102, 202, 302 as described above and shown in FIGS. 1-22. The various clubs in the set may have rear members 130 that may be slightly different in shape, size, location, orientation, etc., based on the loft angle of the club. The various clubs may also have an added weight amount or weight distribution (including CG location) that may be different based on characteristics such as the type and loft angle of the club.

Different rear members 130 and different locations, orientations, and connections thereof, may produce different energy and/or momentum transfer upon impacts on the striking surface 110, et seq., including off-center impacts. Additionally, different rear members 130 and different locations, orientations, and connections thereof, may produce different effects depending on the location of the ball impact on the face 112. Accordingly, one or more clubs can be customized for a particular user by providing a club with a head as described above, with a rear member 130 that is configured in at least one of its shape, size, location, orientation, etc., based on a hitting characteristic of the user, such as a typical hitting pattern or swing speed. Customization may also include adding or adjusting weighting according to the characteristics of the rear member 130 and the hitting characteristic(s) of the user. Still further embodiments and variations are possible, including further techniques for customization.

The ball striking devices described herein may be used by a user to strike a ball or other object, such as by swinging or otherwise moving the head 102, 202, 302 to strike the ball on the striking surface 110 of the face 112. During the striking action, the face 112 impacts the ball, and one or more rear members 130 may transfer energy and/or momentum to the face 112 during the impact, in any manner described above. In one embodiment, the rear member(s) 130 may transfer incrementally greater energy and/or momentum for impacts that are farther from the desired impact point (e.g. the CG). As described below, the devices described herein, when used in this or a comparable method, may assist the user in achieving more consistent accuracy and distance of ball travel, as compared to other ball striking devices.

The various embodiments of ball striking heads with rear members described herein can provide energy and/or momentum transfer upon impacts on the striking face, which can assist in keeping the striking face more square with the ball, particularly on off-center impacts, which can in turn provide more accurate ball direction. Additionally, the energy and/or momentum transfer to the face member can reduce or minimize energy loss on off-center impacts, creating more consistent ball speed and distance. The energy and/or momentum transfer may be incremental based on the distance of the impact away from the desired or optimal impact point. Further, the resilient material and/or the spacer(s) may achieve some energy absorption or damping on center impacts (e.g. aligned with the center point and/or the CG of the face). As a result of the reduced energy loss on off-center hits, reduced twisting of the face on off-center hits, and/or reduced energy transfer on center hits that can be achieved by the heads as described above, greater consistency in both lateral dispersion and distance dispersion can be achieved as compared to typical ball striking heads of the same type, with impacts at various locations on the face. The ball striking heads described herein can also provide dissipation of impact energy through the resilient material, which can reduce vibration of the club head and may improve feel for the user. Still further, the connection members can be used to control the weighting of the club head and/or the rear member. Other benefits can be recognized and appreciated by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face member including a face having a striking surface configured for striking a ball and a rear side located behind the face;

a rear member connected to the rear side of the face member;

a first connection member connecting the face member to the rear member, wherein the first connection member is directly engaged with the rear member, and wherein the club head further includes a first spacer separating the first connection member from the face member, wherein the first spacer is flexible, and the first connection member indirectly engages the face member by compressing the first spacer against the face member; and a resilient material separating the rear member from the face member, wherein the resilient material engages the rear member and the face member and is configured to transfer momentum between the face member and the rear member, wherein the face member comprises a face portion defining at least a portion of the face and a sole portion extending rearward from the face portion and forming at least a portion of a sole of the club head, wherein the rear member is positioned behind the face portion and above the sole portion, and wherein the first connection member connects the sole portion to an underside of the rear member; and wherein the first connection member has a threaded portion and an enlarged head, wherein the rear member has a threaded receiver on the underside that receives and engages the threaded portion of the first connection member, wherein the face member has an opening in the sole portion and a shoulder surrounding the opening, such that the first connection member extends upwardly through the opening and into the receiver, and wherein the first spacer is positioned around the opening and is engaged between the enlarged head and the shoulder.

2. The golf club head of claim 1, further comprising:

an engagement member rigidly engaging the face member and the rear member to form a joint, wherein the engagement member forms a sole area of rigid engagement between the face member and the rear member.

3. The golf club head of claim 1, further comprising:

a second connection member connecting the face member to the rear member, wherein the second connection member is directly engaged with the rear member, and wherein the club head further includes a second spacer separating the second connection member from the face member, wherein the second spacer is flexible, and the second connection member indirectly engages the face member by compressing the second spacer against the face member.

4. The golf club head of claim 3, wherein the first connection member is positioned in a heel portion of the club head and the second connection member is positioned in a toe portion of the club head.

5. The golf club head of claim 1, wherein:

the face member has a cavity surrounding the opening, the cavity being wider than the opening and defined by a cylindrical projection extending from the face member toward the rear member, wherein the shoulder is defined within the cavity, and wherein the enlarged head of the first connection member and the first spacer are received in the cavity;

the rear member has a channel surrounding the receiver, wherein a portion of the cylindrical projection is received within the channel; and the resilient material has a portion that is received within the channel and separates the cylindrical projection from the rear member.

6. A golf club head comprising:

a face member including a face having a striking surface configured for striking a ball and a rear side located behind the face, the face member comprising a face portion at least partially defining the face and a sole portion extending rearward from the face portion and forming at least a portion of a sole of the club head, the sole portion having a first opening on a heel side of the club head and a second opening on a toe side of the club head;

a rear member connected to the rear side of the face member, wherein the rear member has first and second receivers located on an underside of the rear member, the first receiver aligned with the first opening and the second receiver aligned with the second opening;

a resilient material separating the rear member from the face member, wherein the resilient material engages the rear member and the face member and is configured to transfer momentum between the face member and the rear member;

a first connection member connecting the face member to the rear member, wherein the first connection member extends upward through the first opening in the face member and into the first receiver, and wherein the first connection member engages the first receiver by complementary threading members; and a second connection member connecting the face member to the rear member, wherein the second connection member extends upward through the second opening in the face member and into the second receiver, and wherein the second connection member engages the second receiver by complementary threading members, wherein the first and second connection members each have an enlarged head, wherein the sole portion of the face member further has a first cavity surrounding the first opening, the first cavity being wider than the first opening and defined by a first cylindrical projection extending upwardly from the sole portion toward the rear member, the first cavity including a first shoulder surrounding the first opening and a first side wall extending downward from the first shoulder, wherein the enlarged head of the first connection member is received in the first cavity and engages the first shoulder, and wherein the sole portion of the face member further has a second cavity surrounding the second opening, the second cavity being wider than the second opening and defined by a second cylindrical projection extending upwardly from the sole portion toward the rear member, the second cavity including a second shoulder surrounding the second opening and a second side wall extending downward from the second shoulder, wherein the enlarged head of the second connection member is received in the second cavity and engages the second shoulder.

7. The golf club head of claim 6, wherein the first and second connection members are separated from one of the face member and the rear member by a flexible material to prevent rigid engagement with the first and second connection members, the club head further comprising:

an engagement member rigidly engaging the face member and the rear member to form a joint, wherein the engagement member forms a sole point of rigid engagement between the face member and the rear member.

8. The golf club head of claim 6, further comprising a first flexible spacer positioned around the first opening and being engaged between the enlarged head of the first connection member and the first shoulder, such that the first connection member has a non-rigid engagement with the first shoulder, and a second flexible spacer positioned around the second opening and being engaged between the enlarged head of the second connection member and the second shoulder, such that the second connection member has a non-rigid engagement with the second shoulder.

9. The golf club head of claim 6, wherein:

the rear member has first and second channels surrounding the first and second receivers, wherein a portion of the first cylindrical projection is received within the first channel and a portion of the second cylindrical projection is received within the second channel; and the resilient material has portions that are received within the first and second channels and separate the first and second cylindrical projections from the rear member.

10. The golf club head of claim 6, wherein the sole portion of the face member and the rear member each have a first leg extending rearwardly along the heel side of the club head and a second leg extending rearwardly along the toe side of the club head, wherein the first and second legs of the face member and the rear member are spaced from each other to define a void at a rear central portion of the club head.

11. The golf club head of claim 6, wherein the sole portion and the face portion of the face member are formed of a single integral piece.

12. A golf club head comprising:

a face member including a face having a striking surface configured for striking a ball and a rear side located behind the face, the face member having a first opening therein;

a rear member connected to the rear side of the face member, wherein the rear member has a second opening therein, the second opening being aligned with the first opening;

a first connection member connecting the face member to the rear member, wherein the first connection member is received in the first opening and the second opening to connect the face member to the rear member, wherein the first connection member indirectly engages one of the face member and the rear member due to a first flexible spacer positioned around at least a portion of the first connection member and separating the first connection member from the one of the face member and the rear member, and wherein the first connection member directly and rigidly engages the other of the face member and the rear member;

a resilient material separating the rear member from the face member, wherein the resilient material engages the rear member and the face member and is configured to transfer momentum between the face member and the rear member; and an engagement member rigidly engaging the face member and the rear member to form a joint, wherein the engagement member forms a sole area of rigid engagement between the face member and the rear member.

13. The golf club head of claim 12, wherein the face member has a third opening and the rear member has a fourth opening aligned with the third opening, and wherein the club head further comprises a second connection member connecting the face member to the rear member, wherein the second connection member is received in the third opening and the fourth opening to connect the face member to the rear member, wherein the second connection member indirectly engages the one of the face member and the rear member due to a second flexible spacer positioned around at least a portion of the second connection member and separating the second connection member from the one of the face member and the rear member, and wherein the second connection member directly and rigidly engages the other of the face member and the rear member.

14. The golf club head of claim 13, wherein the rear member has perimeter weighting members on a heel side and a toe side of the club head and a thinned center portion, and wherein the second opening and the fourth opening are located in the perimeter weighting members.

15. The golf club head of claim 13, wherein the face member comprises a face portion at least partially defining the face and a sole portion extending rearward from the face portion and forming at least a portion of a sole of the club head, wherein the first and third openings are formed in the sole portion of the face member, and wherein the second and fourth openings are formed in an underside of the rear member.

16. A golf club head comprising:

a face member including a face having a striking surface configured for striking a ball and a rear side located behind the face, the face member having a first opening on a heel side of the club head and a second opening on a toe side of the club head;

a rear member connected to the rear side of the face member, wherein the rear member has first and second receivers, the first receiver aligned with the first opening and the second receiver aligned with the second opening;

a resilient material separating the rear member from the face member, wherein the resilient material engages the rear member and the face member and is configured to transfer momentum between the face member and the rear member;

a first connection member connecting the face member to the rear member, wherein the first connection member extends through the first opening in the face member and into the first receiver, such that the first connection member directly and rigidly engages the first receiver, and wherein the club head further includes a first spacer separating the first connection member from the face member, wherein the first spacer is flexible, and the first connection member indirectly engages the face member by compressing the first spacer against the face member;

a second connection member connecting the face member to the rear member, wherein the second connection member extends through the second opening in the face member and into the second receiver, such that the second connection member directly and rigidly engages the second receiver, and wherein the club head further includes a second spacer separating the second connection member from the face member, wherein the second spacer is flexible, and the second connection member indirectly engages the face member by compressing the second spacer against the face member; and an engagement member rigidly engaging the face member and the rear member to form a joint, wherein the engagement member forms a sole area of rigid engagement between the face member and the rear member.

17. The golf club head of claim 16, wherein the engagement member comprises a projection immovably fixed to one of the face member and the rear member and abutting the other of the face member and the rear member.

18. The golf club head of claim 16, wherein the first connection member and the second connection member each has a threaded portion and an enlarged head, and wherein the first receiver and the second receiver are threaded and engage the threaded portions of the first and second connection members, wherein the face member has a first shoulder surrounding the first opening and a second shoulder surrounding the second opening, wherein the first spacer is positioned around the first opening and is engaged between the enlarged head of the first connection member and the first shoulder, and wherein the second spacer is positioned around the second opening and is engaged between the enlarged head of the second connection member and the second shoulder.

19. The golf club head of claim 18, wherein:

the face member has a first cavity surrounding the first opening, the first cavity being wider than the first opening, wherein the first shoulder is defined within the first cavity, and wherein the enlarged head of the first connection member and the first spacer are received in the first cavity; and the face member has a second cavity surrounding the second opening, the second cavity being wider than the second opening, wherein the second shoulder is defined within the second cavity, and wherein the enlarged head of the second connection member and the second spacer are received in the second cavity.

20. The golf club head of claim 19, wherein:

the first cavity is defined by a first cylindrical projection extending from the face member toward the rear member, and the second cavity is defined by a second cylindrical projection extending from the face member toward the rear member;

the rear member has a first channel surrounding the first receiver, and a second channel surrounding the second receiver, wherein portions of the first and second cylindrical projections are received within the first and second channels; and the resilient material has portions received within the first and second channels and separating the first and second cylindrical projections from the rear member.

21. The golf club head of claim 19, wherein the first cavity has a cylindrical side wall that is transverse to the first shoulder, wherein the first spacer is further positioned between the enlarged head and the side wall.

22. The golf club head of claim 16, wherein the face member comprises a face portion defining at least a portion of the face and a sole portion extending rearward from the face portion and forming at least a portion of a sole of the club head, wherein the rear member is positioned behind the face portion and above the sole portion, wherein the first and second openings extend through the sole portion of the face member, wherein the first and second receivers are defined in an underside of the rear member, and wherein the first and second connection members extend upward through the first and second openings and into the first and second receivers to connect the sole portion to the underside of the rear member.

23. The golf club head of claim 16, wherein the engagement member is laterally aligned with a center of gravity of the face member and a center of gravity of the rear member.

24. The golf club head of claim 16, wherein the first spacer completely separates the first connection member from the face member such that the first connection member can only engage the face member indirectly.

25. A golf club head comprising:

a face member including a face having a striking surface configured for striking a ball and a rear side located behind the face;

a rear member connected to the rear side of the face member;

a first connection member connecting the face member to the rear member, wherein the first connection member is directly engaged with the rear member, and wherein the club head further includes a first spacer separating the first connection member from the face member, wherein the first spacer is flexible, and the first connection member indirectly engages the face member by compressing the first spacer against the face member;

a resilient material separating the rear member from the face member, wherein the resilient material engages the rear member and the face member and is configured to transfer momentum between the face member and the rear member; and an engagement member rigidly engaging the face member and the rear member to form a joint, wherein the engagement member forms a sole area of rigid engagement between the face member and the rear member.

26. The golf club head of claim 25, wherein the engagement member comprises a projection fixed to one of the face member and the rear member and abutting the other of the face member and the rear member.

27. The golf club head of claim 25, wherein the resilient material has a gap allowing the engagement member to extend through the resilient material to engage both the face member and the rear member.

28. A golf club head comprising:

a face member including a face having a striking surface configured for striking a ball and a rear side located behind the face;

a rear member connected to the rear side of the face member;

a first connection member connecting the face member to the rear member, wherein the first connection member is directly engaged with the rear member, and wherein the club head further includes a first spacer separating the first connection member from the face member, wherein the first spacer is flexible, and the first connection member indirectly engages the face member by compressing the first spacer against the face member; and a resilient material separating the rear member from the face member, wherein the resilient material engages the rear member and the face member and is configured to transfer momentum between the face member and the rear member, wherein the first connection member has a threaded portion and an enlarged head, wherein the rear member has a threaded receiver receiving and engaging the threaded portion of the first connection member, wherein the face member has an opening and a shoulder surrounding the opening, such that the first connection member extends through the opening and into the receiver, and wherein the first spacer is positioned around the opening and is engaged between the enlarged head and the shoulder, wherein the face member has a cavity surrounding the opening, the cavity being wider than the opening and defined by a cylindrical projection extending from the face member toward the rear member, wherein the shoulder is defined within the cavity, and wherein the enlarged head of the first connection member and the first spacer are received in the cavity, wherein the rear member has a channel surrounding the receiver, wherein a portion of the cylindrical projection is received within the channel, and wherein the resilient material has a portion that is received within the channel and separates the cylindrical projection from the rear member.

29. The golf club head of claim 28, wherein the cavity has a cylindrical side wall that is transverse to the shoulder, wherein the first spacer is further positioned between the enlarged head and the side wall.

30. A golf club head comprising:

a face member including a face having a striking surface configured for striking a ball and a rear side located behind the face, the face member comprising a face portion at least partially defining the face and a sole portion extending rearward from the face portion and forming at least a portion of a sole of the club head, the sole portion having a first opening on a heel side of the club head and a second opening on a toe side of the club head;

a rear member connected to the rear side of the face member, wherein the rear member has first and second receivers located on an underside of the rear member, the first receiver aligned with the first opening and the second receiver aligned with the second opening;

a resilient material separating the rear member from the face member, wherein the resilient material engages the rear member and the face member and is configured to transfer momentum between the face member and the rear member;

a first connection member connecting the face member to the rear member, wherein the first connection member extends upward through the first opening in the face member and into the first receiver, and wherein the first connection member engages the first receiver by complementary threading members; and a second connection member connecting the face member to the rear member, wherein the second connection member extends upward through the second opening in the face member and into the second receiver, and wherein the second connection member engages the second receiver by complementary threading members, wherein the sole portion of the face member and the rear member each have a first leg extending rearwardly along the heel side of the club head and a second leg extending rearwardly along the toe side of the club head, wherein the first and second legs of the face member and the rear member are spaced from each other to define a void at a rear central portion of the club head.

31. The golf club head of claim 30, wherein the first receiver is defined within the first leg of the rear member and the second receiver is defined within the second leg of the rear member, and wherein the first opening is defined within the first leg of the face member and the second opening is defined within the second leg of the face member.

32. The golf club head of claim 30, wherein the void is narrower proximate the face and wider proximate a rear of the club head.

* * * * *